US011109675B2

(12) United States Patent
Hayes et al.

(10) Patent No.: US 11,109,675 B2
(45) Date of Patent: Sep. 7, 2021

(54) CONNECTORS, AND SYSTEMS INCLUDING CONNECTORS IN ADDITION TO DRAWERS, CABINETS AND/OR DRAWER MOVEMENT GUIDE ASSEMBLIES

(71) Applicant: Grass America Inc., Kernersville, NC (US)

(72) Inventors: Toni Claire Hayes, Greensboro, NC (US); Jen-Cheng Jiang, Kernersville, NC (US); Gabriel Auer, Maeder (AT); Tim Lucas, Leinfelden-Echterdingen (DE)

(73) Assignee: Grass America Inc., Kernersville, NC (US)

( * ) Notice: Subject to any disclaimer, the term of this patent is extended or adjusted under 35 U.S.C. 154(b) by 0 days.

(21) Appl. No.: 16/587,809

(22) Filed: Sep. 30, 2019

(65) Prior Publication Data

US 2020/0383474 A1 Dec. 10, 2020

Related U.S. Application Data

(60) Provisional application No. 62/856,896, filed on Jun. 4, 2019.

(51) Int. Cl.

| | |
|---|---|
| ***A47B 88/427*** | (2017.01) |
| ***A47B 88/447*** | (2017.01) |
| ***A47B 88/407*** | (2017.01) |

(52) U.S. Cl.

CPC ..... *A47B 88/427* (2017.01); *A47B 88/407* (2017.01); *A47B 88/447* (2017.01); *A47B 2088/4276* (2017.01)

(58) Field of Classification Search

CPC ..... A47B 88/40; A47B 88/407; A47B 88/427; A47B 88/447

(Continued)

(56) References Cited

U.S. PATENT DOCUMENTS 9,808,083 B2 11/2017 Lucas
9,907,399 B2 3/2018 Lucas (Continued)

FOREIGN PATENT DOCUMENTS

CN 109393788 * 3/2019 ..... A47B 88/407

OTHER PUBLICATIONS

U.S. Appl. No. 16/209,156, filed Dec. 4, 2018, Tim, Lucas.
U.S. Appl. No. 16/209,175, filed Dec. 4, 2018, Tim, Lucas.

*Primary Examiner* — James O Hansen
(74) *Attorney, Agent, or Firm* — Burr & Brown, PLLC

(57) ABSTRACT

A connector comprising a carriage, an adjustment element, and a base configured to be rigidly attached to a drawer, the carriage is slidably attached to the base, and movement of the adjustment element causes the carriage to slide relative to the base. Also, such a connector further comprising: an engagement element configured to releasably engage a drawer movement guide assembly and attached to the carriage, and/or a wedge element linearly slidable relative to the carriage and configured to cause a change in a spacing between a drawer movement guide assembly and a drawer. Also, a connector comprising an engagement element that is separate from and pivotally attached to a connector assembly, that is configured to be rigidly attached to a drawer, and that is configured to releasably engage a drawer movement guide assembly. Also, systems comprising a connector together with a drawer, a cabinet and/or a drawer guide.

20 Claims, 20 Drawing Sheets

(58) Field of Classification Search
USPC ..... 312/330.1, 334.1, 334.4, 334.5
See application file for complete search history.

(56) References Cited

U.S. PATENT DOCUMENTS

| | | | | |
|---|---|---|---|---|
| 2013/0257244 | A1* | 10/2013 | Salice | A47B 88/423<br>312/319.1 |
| 2014/0314347 | A1* | 10/2014 | Huang | A47B 88/407<br>384/22 |
| 2017/0095081 | A1 | 4/2017 | Lucas | |
| 2017/0095082 | A1 | 4/2017 | Lucas | |
| 2017/0095083 | A1 | 4/2017 | Lucas | |

* cited by examiner

CONNECTORS, AND SYSTEMS INCLUDING CONNECTORS IN ADDITION TO DRAWERS, CABINETS AND/OR DRAWER MOVEMENT GUIDE ASSEMBLIES

CROSS-REFERENCE TO RELATED APPLICATIONS

This application claims the benefit under 35 U.S.C. 119 section (e) of U.S. Provisional Patent Application No. 62/856,896, filed Jun. 4, 2019, the entirety of which is incorporated herein by reference.

FIELD OF THE INVENTIVE SUBJECT MATTER

In some aspects, the present inventive subject matter relates to components used in drawers and cabinets, more particularly, connectors for connecting drawers to cabinets. The present inventive subject matter also relates to systems that comprise one or more connectors, one or more cabinets, one or more drawers, and/or one or more drawer movement guide assembly.

BACKGROUND

Needless to say, there is known a wide variety of cabinet and drawer combinations (i.e., in which a cabinet and one or more drawers are configured to be used with each other), and such cabinet and drawer combinations have been known to exist in a wide variety of shapes, materials, sizes, numbers of drawers, locations of drawers, numbers of sides in which drawers are located, numbers of directions in which respective drawers slide, etc. As will be evident from the description herein, the present inventive subject matter is not limited to any particular type of cabinet and drawer combination (e.g., shape, material, size, number of drawers, locations of drawers, number of sides in which drawers are located, number of directions in which respective drawers slide, etc.). In order to assist in describing the present inventive subject matter, reference is made in some instances herein to specific cabinet and drawer combinations.

For example, there exist many cabinet and drawer combinations in which the cabinet defines a cabinet interior space, each of one or more drawers has a respective drawer space defined by at least a bottom of the drawer, at least one sidewall of the drawer, and an at least partially open top of the drawer, each of the one or more drawers is slidable relative to the cabinet between an open position in which at least part of the open top of the drawer is outside the cabinet interior space (i.e., the drawer space is accessible) and a closed position in which the entire open top of the drawer is inside the cabinet interior space (i.e., the drawer space is not accessible).

In many of such cabinet and drawer combinations, there are provided drawer-movement-guide assemblies that assist in guiding movement of the drawer(s) relative to the cabinet.

BRIEF SUMMARY OF THE INVENTIVE SUBJECT MATTER

There is an ongoing need for more reliable, precise, easy-to-operate and/or easy-to-install ways to facilitate movement of drawers relative to cabinets. There is also an ongoing need for more reliable, precise, easy-to-operate and/or easy-to-install ways to allow for such movement and provide more reliable and precise positioning, relative to the cabinets, of drawers (e.g., such that portions of the drawers (e.g., drawer fronts) that are visible when the drawers are in their respective closed positions, are in a proper location and/or are aligned with other drawers in a cabinet.

In some aspects, the present inventive subject matter is directed to a connector that is configured to enable a drawer to be moved relative to a drawer movement guide assembly that is attached to a cabinet.

In some aspects, the present inventive subject matter is directed to a connector that comprises a base and a carriage, in which:

the base is configured to be rigidly attached to a drawer,
the carriage comprises one of more features that are configured to engage with a drawer movement guide assembly, and
the carriage is slidably attached to the base, whereby the connector is capable of being implemented with a drawer and a cabinet (to which a drawer movement guide assembly is attached) such that the drawer can be caused to move (e.g., laterally, i.e., selectively right or left) relative to the drawer movement guide assembly (and thus also relative to the cabinet) by sliding the carriage relative to the base. In some of such aspects, the connector further comprises a wedge element that is configured to be moved in a way that (with the connector implemented) causes the drawer to be moved in directions other than the directions the drawer can be moved by sliding the carriage relative to the base, e.g., to cause the drawer to be moved vertically (i.e., selectively up or down).

In some aspects, the present inventive subject matter is directed to such a connector, in which the connector further comprises an adjustment element, and the sliding movement of the carriage relative to the base can be caused by moving the adjustment element.

In accordance with a first aspect of the present inventive subject matter, there is provided a connector that comprises:

a base;
a carriage;
an adjustment element; and
an engagement element,
the base is configured to be rigidly attached to a drawer,
the carriage is slidably attached to the base,
movement of the adjustment element causes the carriage to slide relative to the base,
the engagement element is configured to releasably engage a drawer movement guide assembly,
the engagement element is attached to the carriage,
whereby sliding the carriage causes the engagement element to move relative to the base.

In some embodiments according to the first aspect of the present inventive subject matter, which can include or not include, as suitable, any of the other features described herein, at least one portion (referred to herein as a "carriage positioning region") of the carriage is configured to engage a drawer movement guide assembly (e.g., a protrusion on the carriage is a carriage positioning region and fits within a rail of the drawer movement guide assembly, or a recess on the carriage is a carriage positioning region and a rail of the drawer movement guide assembly fits within the recess), and the carriage positioning region causes (or assists in causing) the drawer to move relative to the drawer movement guide assembly upon sliding the carriage relative to the base (because the carriage is engaged with the drawer movement guide assembly and the base is attached to the drawer). In some of such embodiments, (1) a pair of such connectors (a right connector and a left connector) are configured to be used in an arrangement in which a pair of drawer movement guide assemblies are attached horizontally to a cabinet (a right drawer movement guide assembly on or near the right side of the cabinet, and a left drawer movement guide assembly on or near the left side of the cabinet, the left drawer movement guide assembly and the right drawer movement guide assembly at about the same height), the drawer rests on the left drawer movement guide assembly and the right drawer movement guide assembly (such that the drawer is substantially horizontal), the base of the right connector is attached to the interior surface of the front portion of the drawer, the carriage of the right connector is engaged with the right drawer movement guide assembly (such that movement of the adjustment element of the right connector causes the front portion of the drawer to move laterally, thereby adjusting the position of the front portion of the drawer relative to the cabinet), the base of the left connector is attached to the interior surface of the front portion of the drawer, and the carriage of the left connector is engaged with the left drawer movement guide assembly (such that movement of the adjustment element of the left connector causes the front portion of the drawer to move laterally, thereby adjusting the position of the front portion of the drawer relative to the cabinet), (2) engagement between the engagement element on the right connector with an engagement region on the right drawer movement guide assembly causes the right connector and the engagement region on the right drawer movement guide assembly to move together upon the drawer being pushed forward or backward (and similarly, engagement between the engagement element on the left connector with an engagement region on the left drawer movement guide assembly causes the left connector and the engagement region on the left drawer movement guide assembly to move together upon the drawer being pushed forward or backward), and (3) if the engagement region on the right connector is moved out of engagement with the engagement region on the right drawer movement guide assembly and the engagement region on the left connector is moved out of engagement with the engagement region on the left drawer movement guide assembly, the drawer is disengaged from the drawer movement guides assemblies, and can be slid out of the cabinet.

In accordance with the first aspect of the present inventive subject matter, because the engagement element is attached to the carriage, sliding the carriage relative to the base causes the engagement element to move relative to the base, such that if the base is attached to a drawer, sliding the carriage relative to the base causes the engagement element to move relative to the drawer, and thus, for example, in embodiments as described above that have a left drawer movement guide assembly and a right drawer movement guide assembly attached to a cabinet, upon sliding the carriage relative to the base, the carriage positioning region of the carriage stays engaged with the drawer movement guide assembly, such that the base (and thus the drawer front attached to the base) moves relative to the drawer movement guide assembly (and thus the cabinet, to which the drawer movement guide assembly is attached), while the engagement element (attached to the carriage) stays in place relative to the drawer movement guide assembly (with which the carriage is engaged).

In some embodiments according to the first aspect of the present inventive subject matter, which can include or not include, as suitable, any of the other features described herein, the connector further comprises a wedge element which is movably attached to the carriage, and which is configured to cause, by the wedge element being moved, a change in a spacing between a first portion of a drawer movement guide assembly and a portion of a drawer that is on the first portion of the drawer movement guide assembly. In some of such embodiments, e.g., in embodiments as described above that have a left drawer movement guide assembly and a right drawer movement guide assembly attached to a cabinet, the movement of the wedge element causes a change in the spacing between the drawer (which rests on the left drawer movement guide assembly and the right drawer movement guide assembly) and the drawer movement guide assembly with which the connector is engaged. In such embodiments, because the wedge element is attached to the carriage, sliding the carriage relative to the base causes the wedge element to move relative to the base, such that if the base is attached to a drawer, sliding the carriage relative to the base causes the wedge element to move relative to the drawer, and thus, for example, in embodiments as described above that have a left drawer movement guide assembly and a right drawer movement guide assembly attached to a cabinet, sliding the carriage relative to the base causes the wedge to stay in place relative to the drawer movement guide assembly.

In accordance with a second aspect of the present inventive subject matter, there is provided a connector, comprising:

- a base;
- a carriage;
- an adjustment element; and
- a wedge element,
- the base is configured to be rigidly attached to a drawer,
- the carriage is slidably attached to the base,
- movement of the adjustment element causes the carriage to slide relative to the base,
- the wedge element is slidably attached to the carriage,
- the wedge element is linearly slidable relative to the carriage between a wedge element first position and a wedge element second position,
- the wedge element is configured to cause a change in a spacing between a first portion of a drawer movement guide assembly and a portion of a drawer that is on the first portion of the drawer movement guide assembly, by the wedge element being moved from the wedge element first position to the wedge element second position.

In accordance with a third aspect of the present inventive subject matter, there is provided a connector, comprising:

- a connector assembly; and
- an engagement element,
- a first portion of the connector assembly is configured to be rigidly attached to a drawer,
- the engagement element is configured to releasably engage a drawer movement guide assembly,
- the engagement element is a separate structure from the connector assembly,
- the engagement element is pivotally attached to the connector assembly, and
- the engagement element is pivotable relative to the connector assembly about an engagement element pivot axis.

The inventive subject matter may be more fully understood with reference to the accompanying drawings and the following detailed description of the inventive subject matter.

BRIEF DESCRIPTION OF THE DRAWING FIGURES

FIG. 1 is a schematic drawing depicting an overhead view (with the top of the cabinet 140 removed) of a representative example of a pair of drawer movement guide assemblies 130 which are attached to a representative example of a cabinet 140 and which support a representative example of a drawer 150.

Figure 8A:
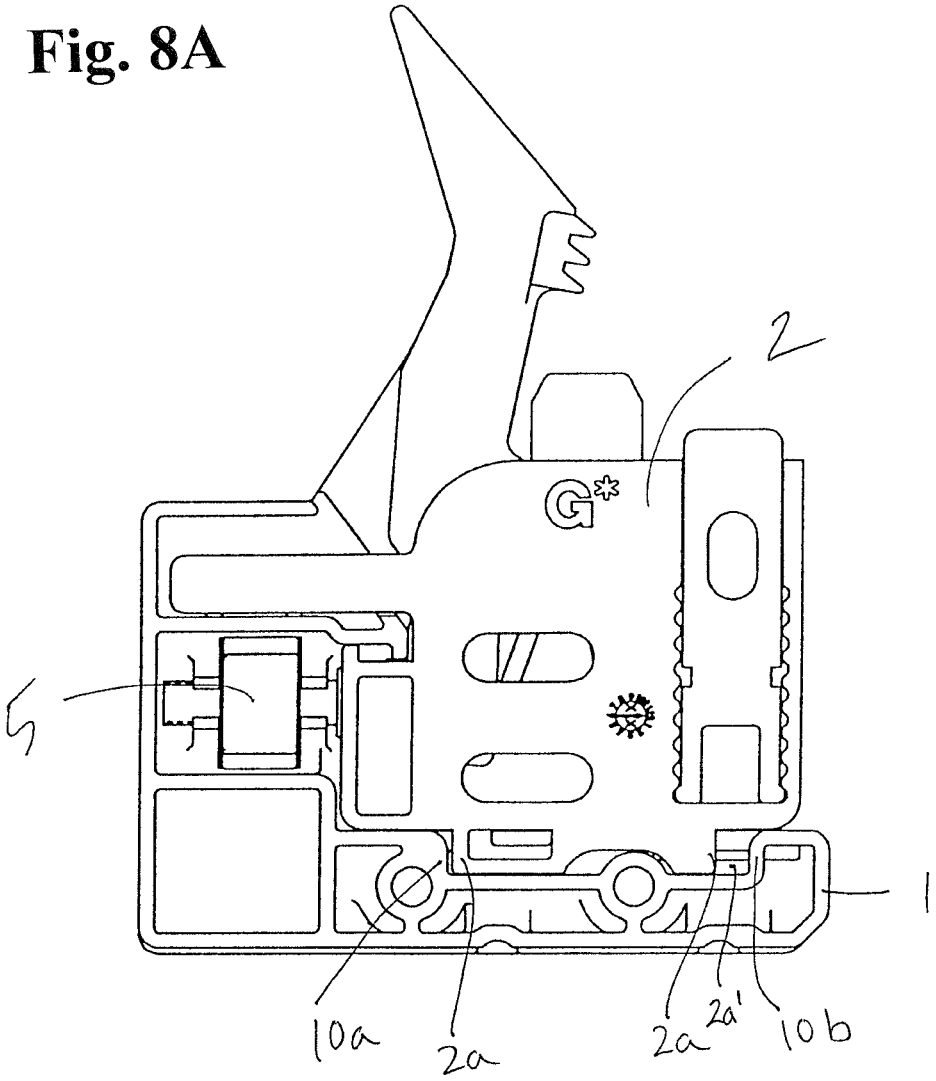
Figure 8B:
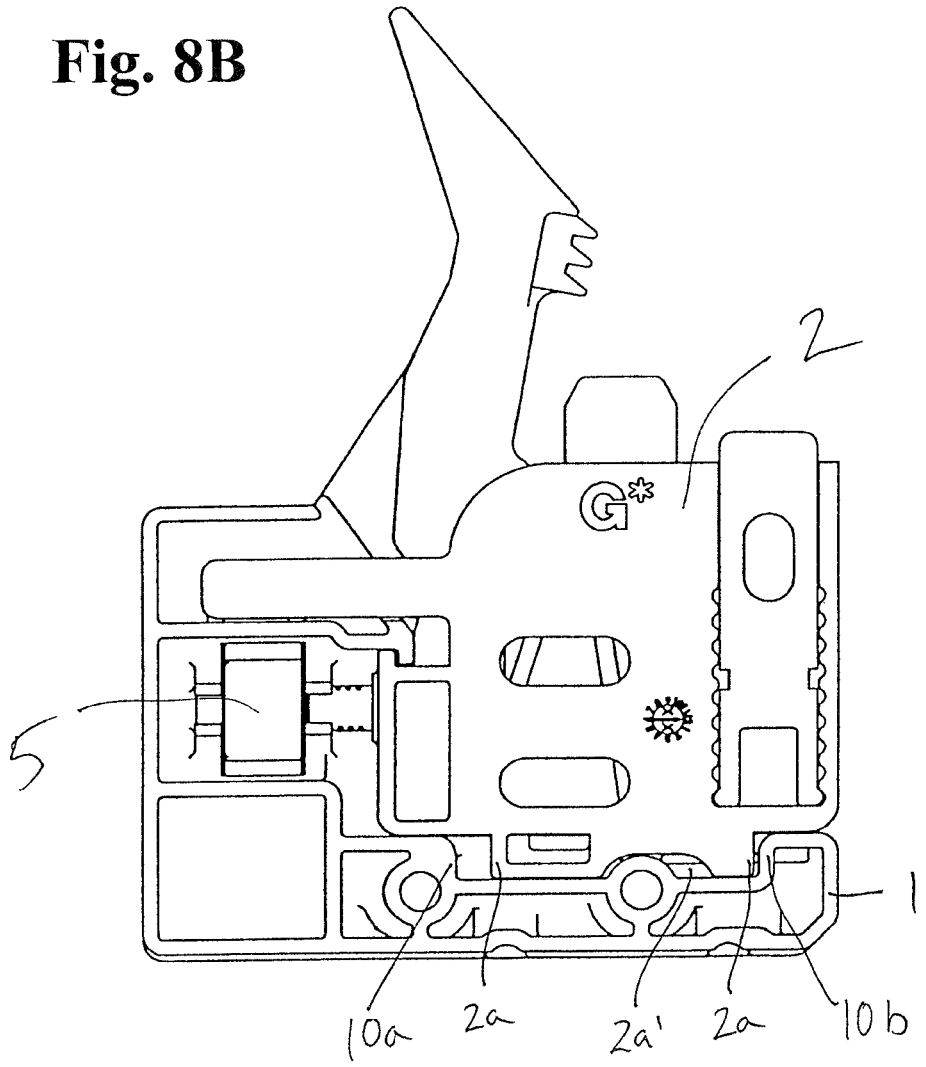
Figure 9A:
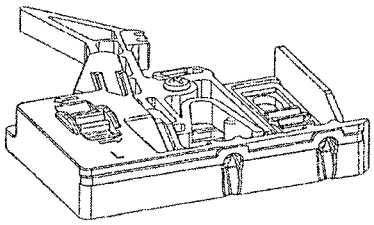
Figure 9B:
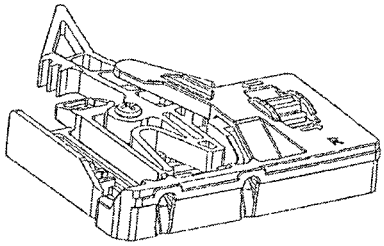
Figure 9C:
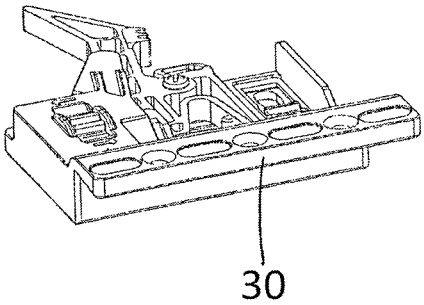
Figure 9D:
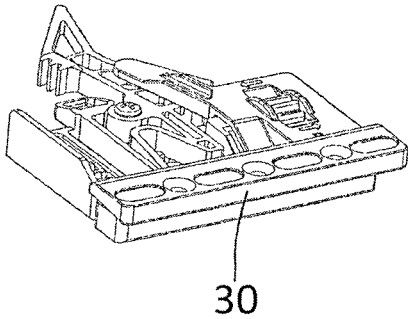

FIGS. 8A and 8B are bottom views showing the right-most and left-most relative positions of the carriage 2 and the base 1 by actuation of the thumb wheel 5.

FIGS. 9A-9D are perspective views of a left-side connector, a right-side connector, another left-side connector with a flange 30 and another right-side connector with a flange 30.

Figure 10:
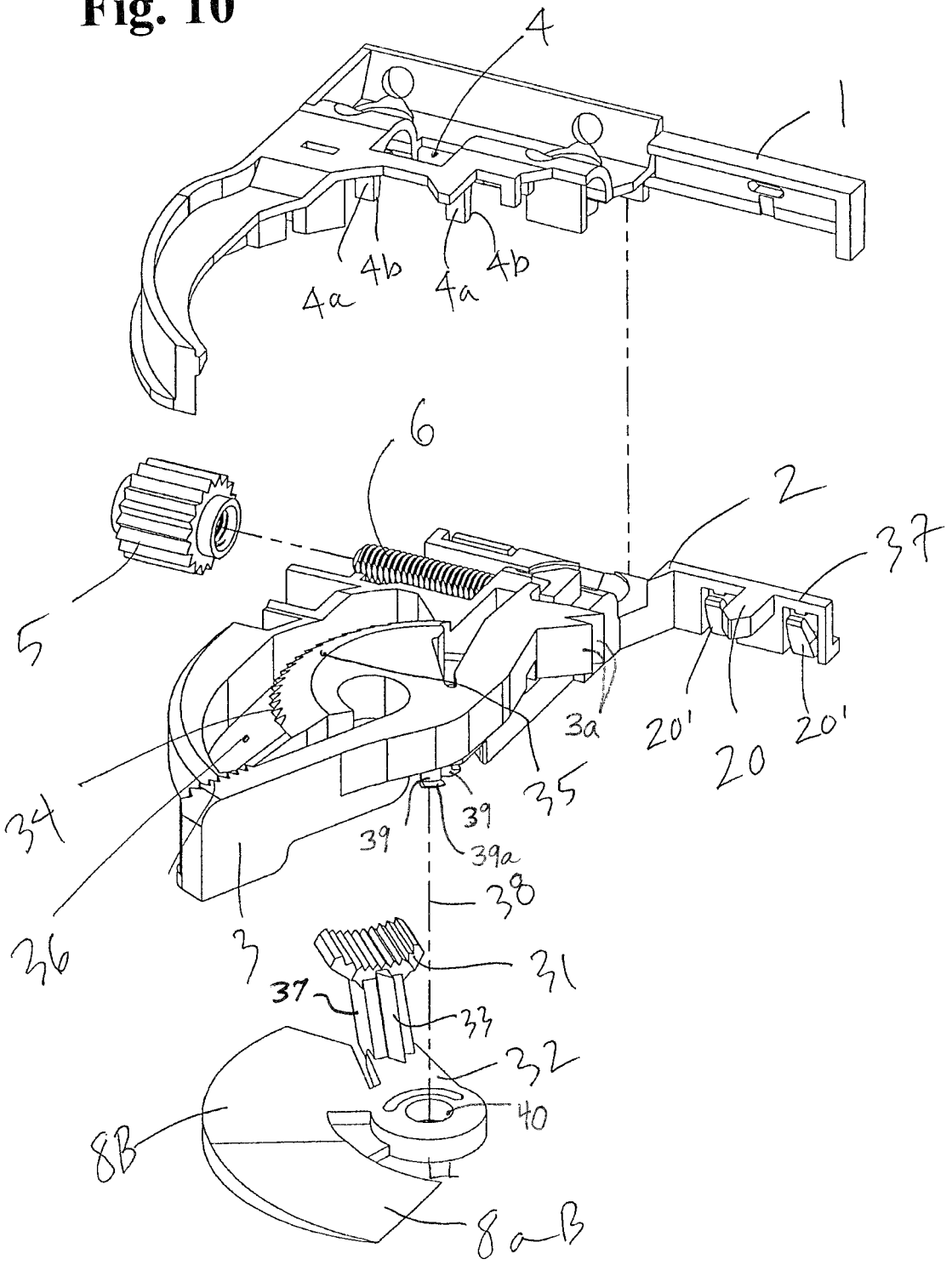
Figure 11:
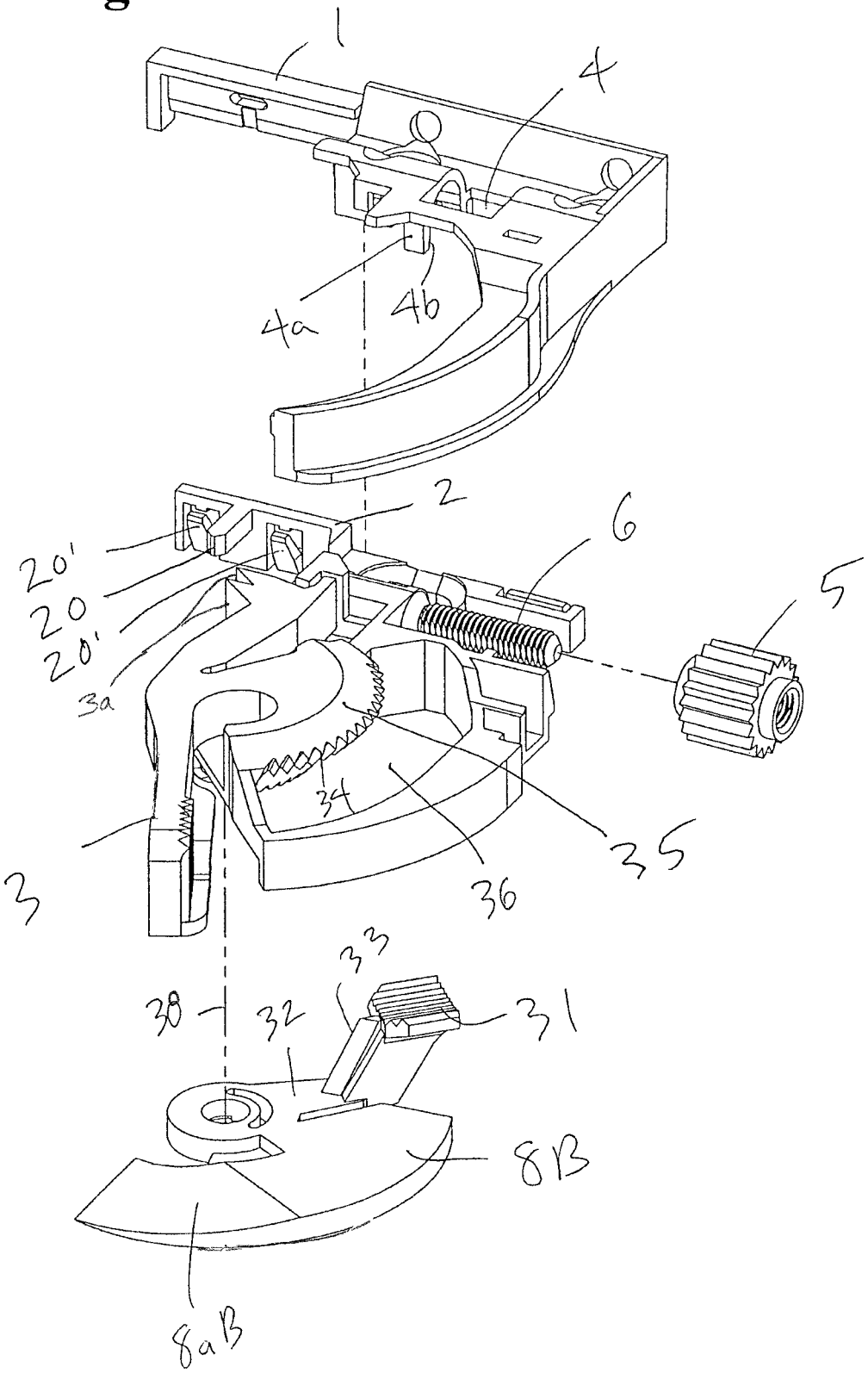

FIGS. 10 and 11 show another embodiment of right-side and left-side connectors, respectively, according to a second embodiment of the present invention.

Figure 12A:
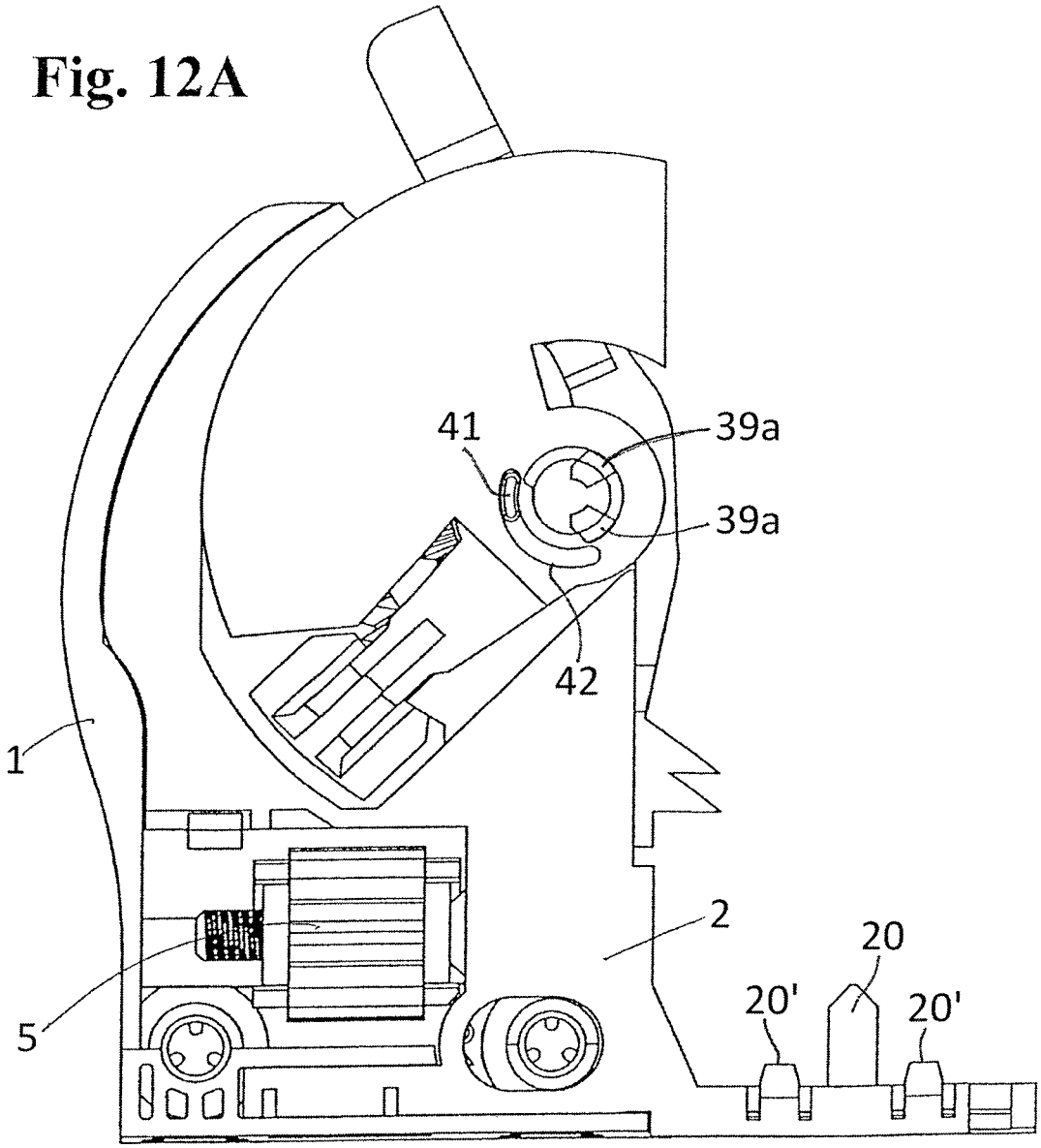
Figure 12B:
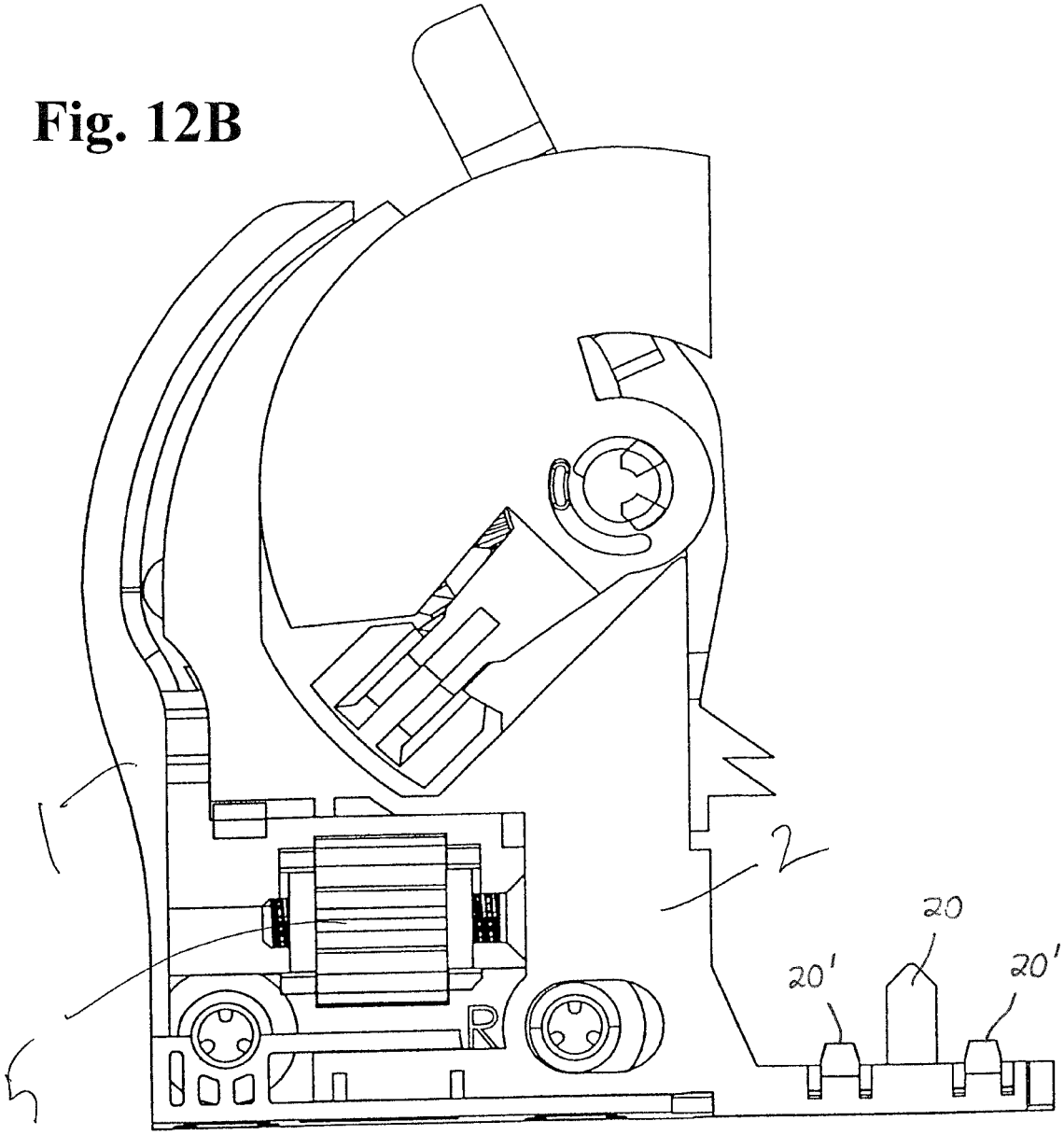

FIGS. 12A and 12B are bottom views showing the right-most and left-most relative positions of the carriage 2 and the base 1.

Figure 5:
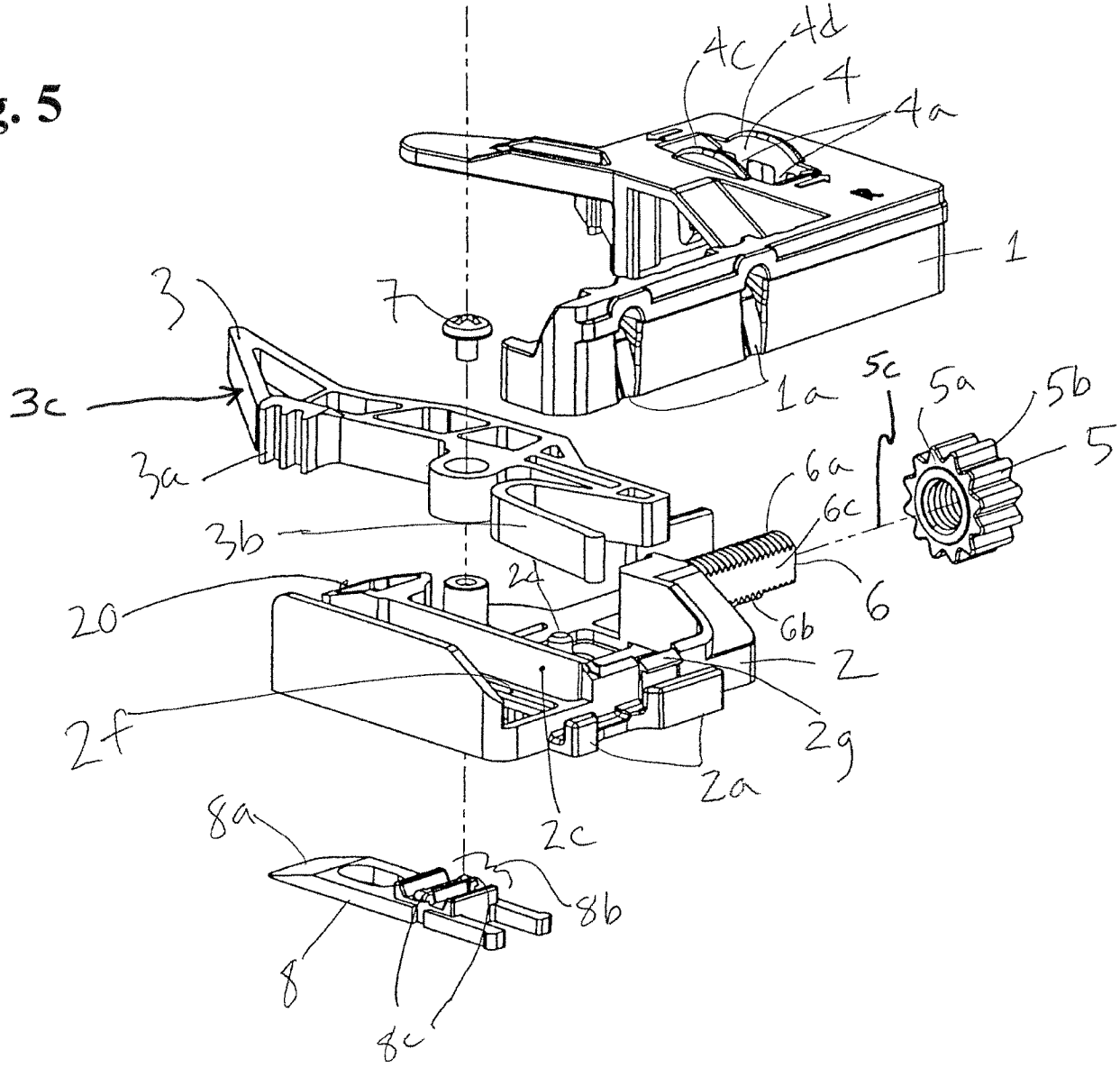
FIGS. 5 and 6 are exploded views of representative embodiments of connectors in accordance with the present inventive subject matter.
Figure 6:
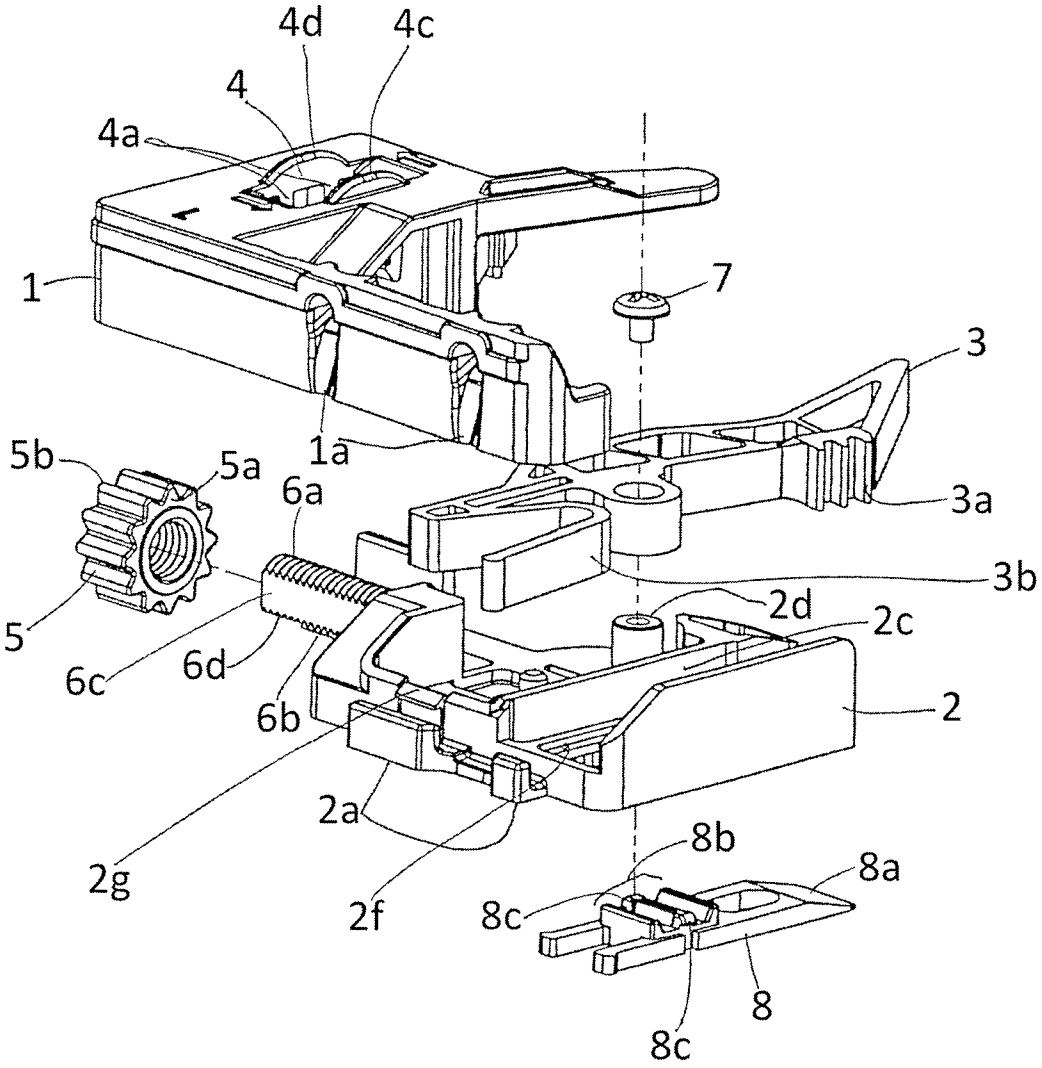
Figure 13A:
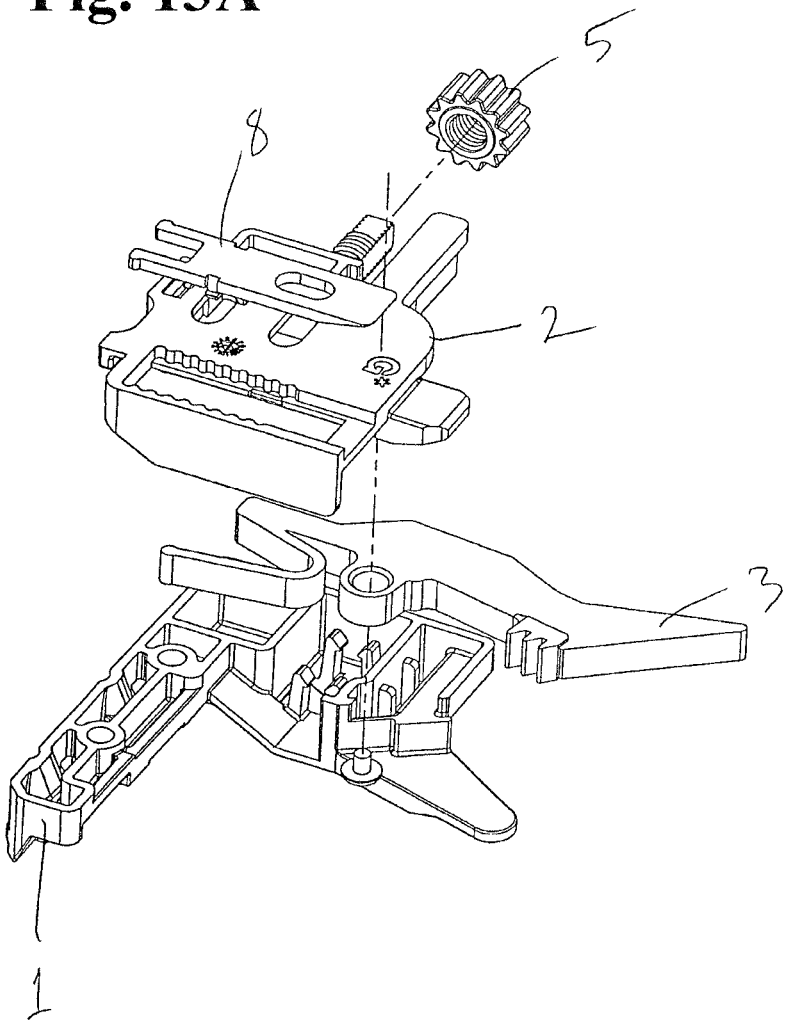
Figure 13B:
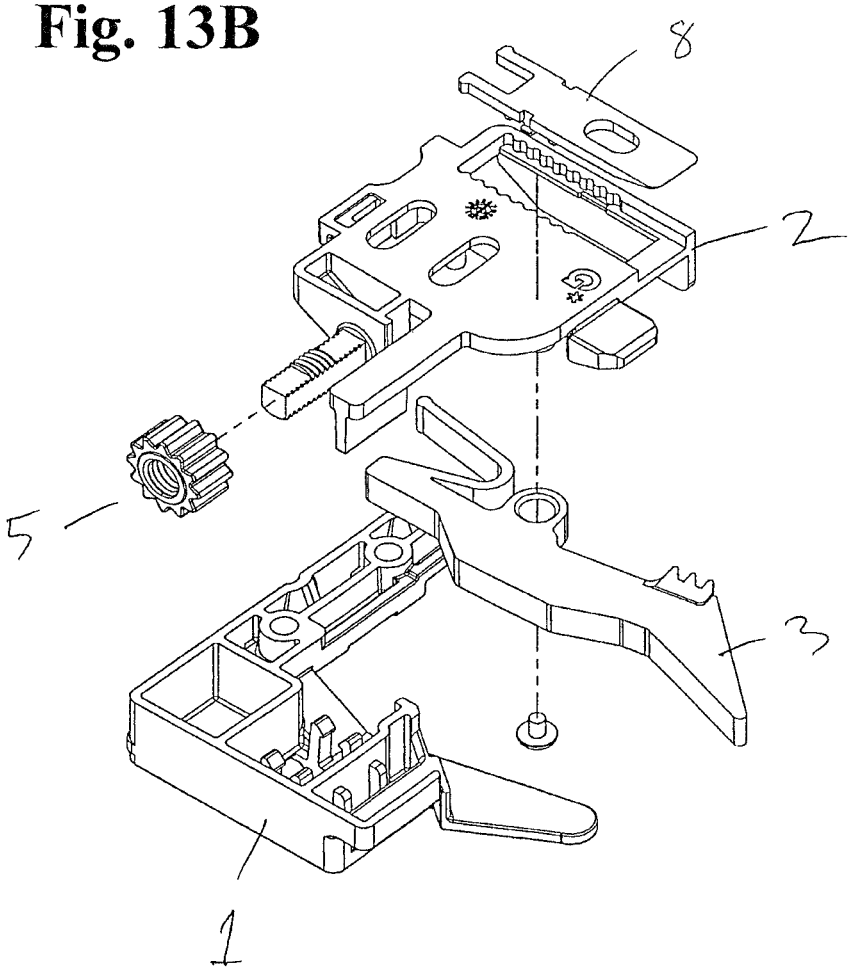

FIG. 13A is a bottom, exploded perspective view of the connector shown in FIG. 5, and FIG. 13B is a bottom, exploded perspective view of the connector shown in FIG. 6.

Figure 14A:
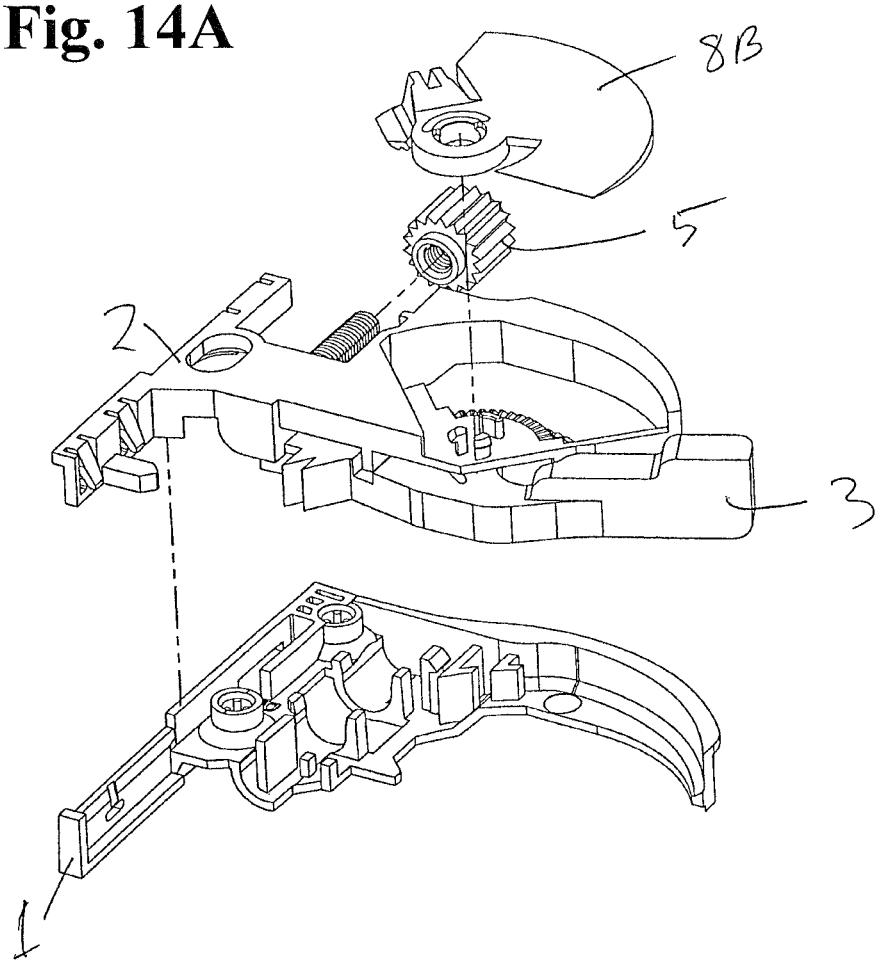
Figure 14B:
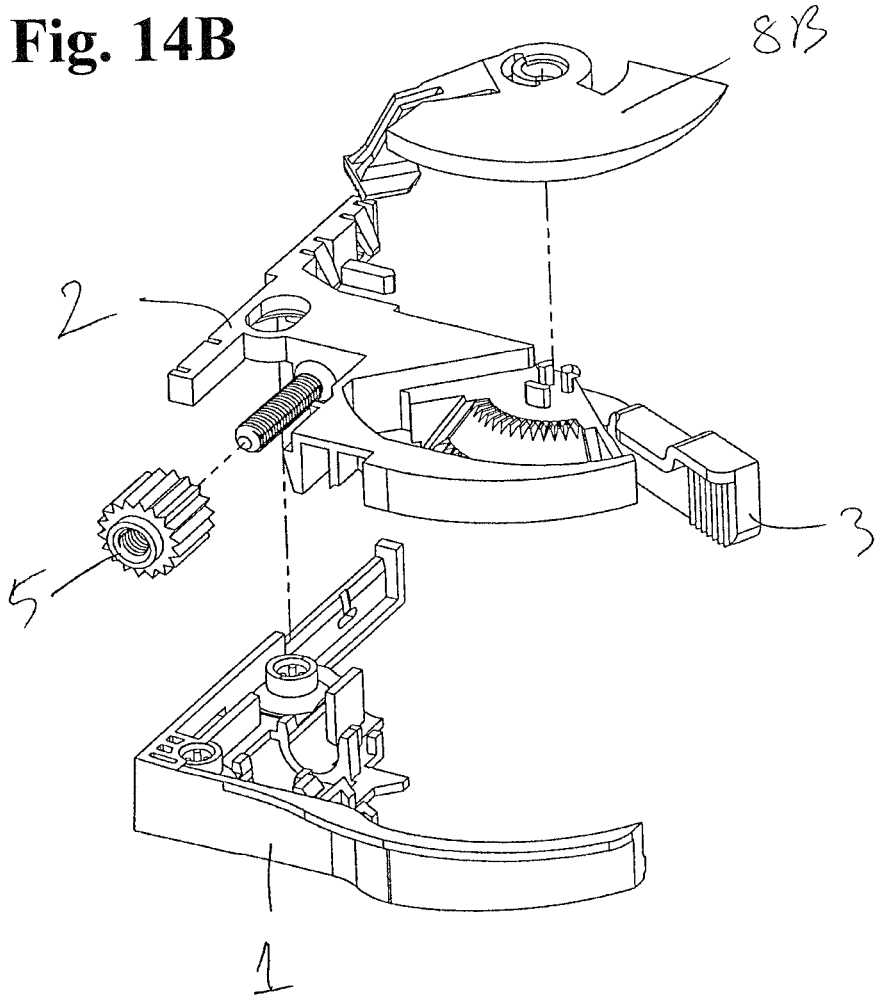

FIG. 14A is a bottom, exploded perspective view of the connector shown in FIG. 10, and FIG. 14B is a bottom, exploded perspective view of the connector shown in FIG. 11.

Figure 15:
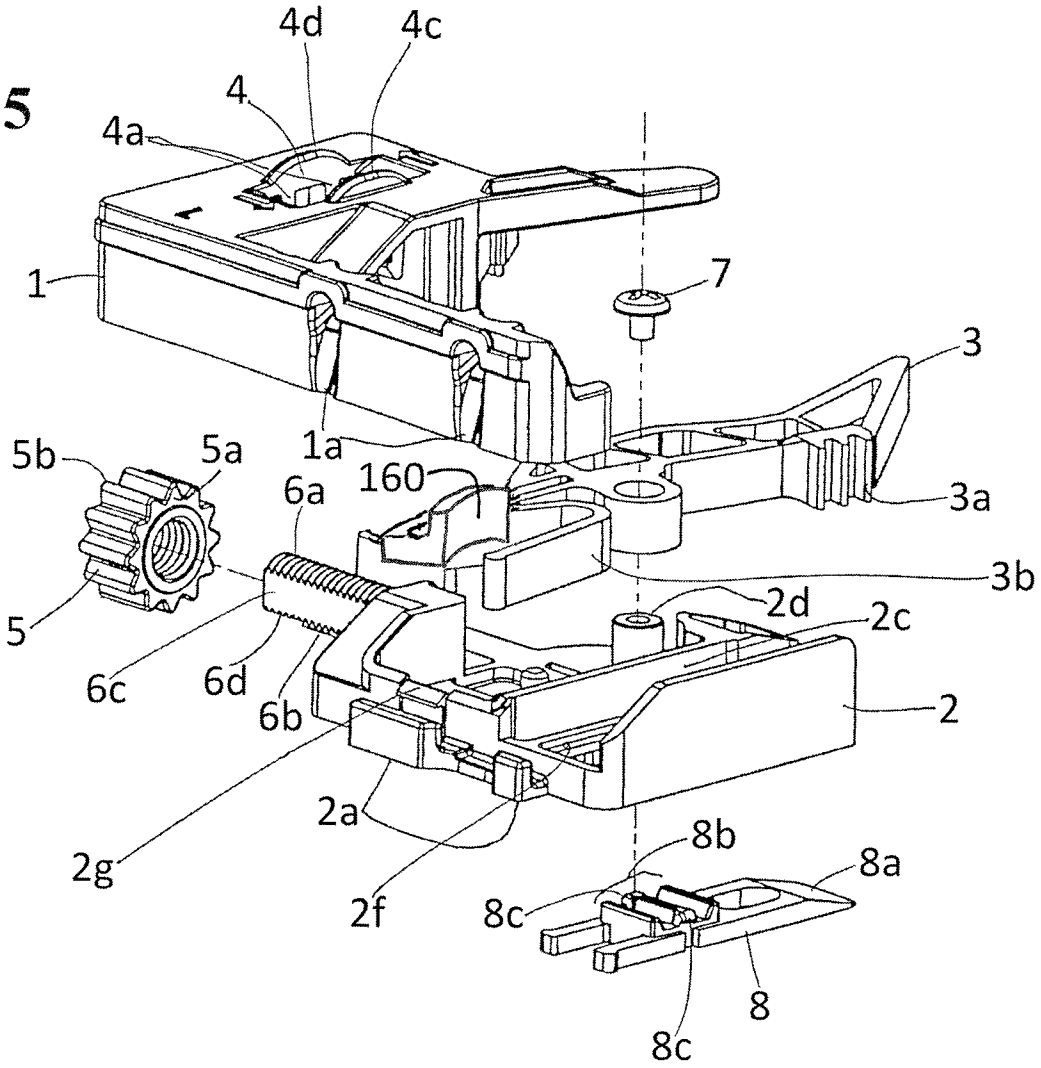

FIG. 15 depicts another embodiment of a connector in accordance with the present inventive subject matter.

Figure 1:
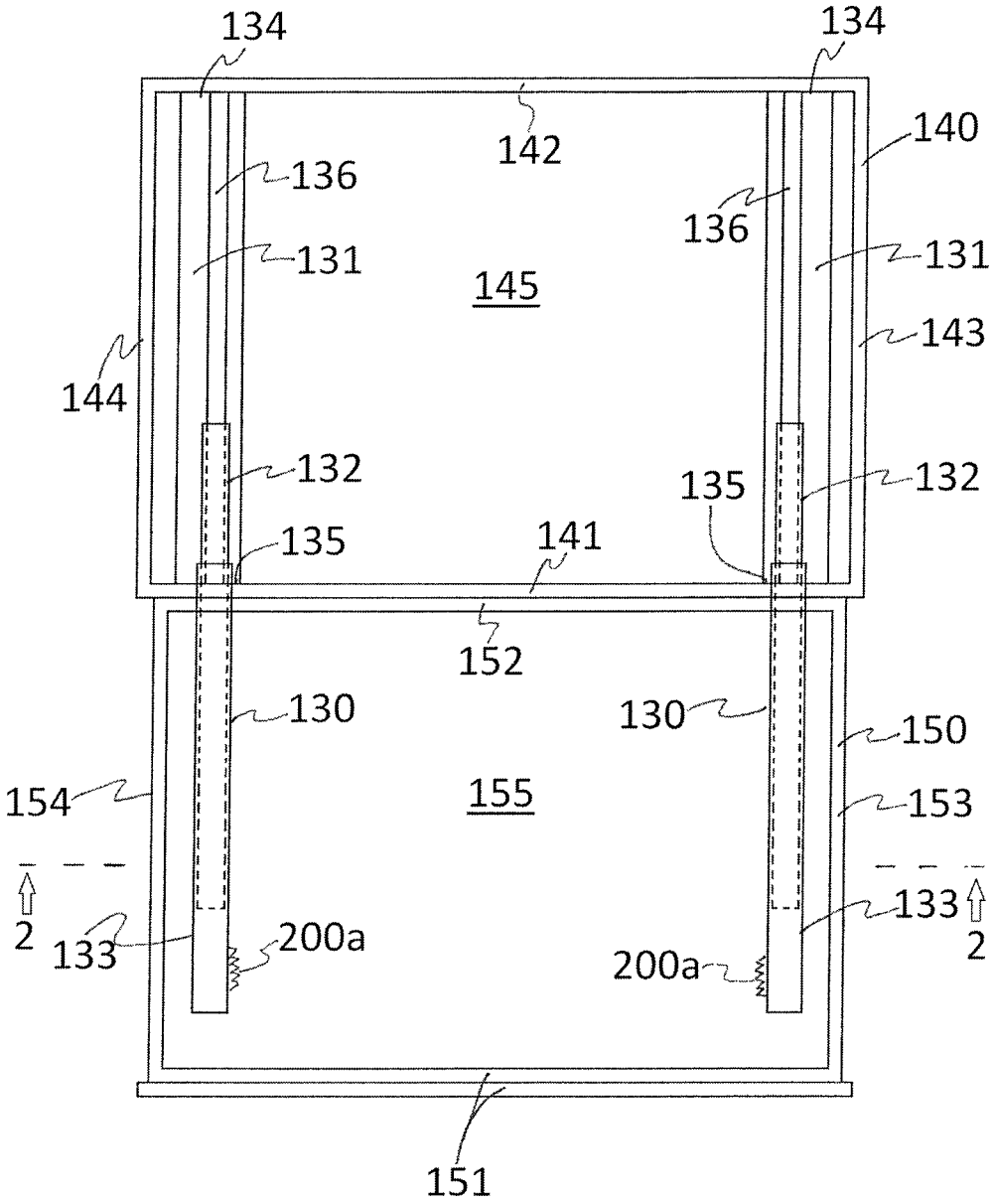
Figure 16:
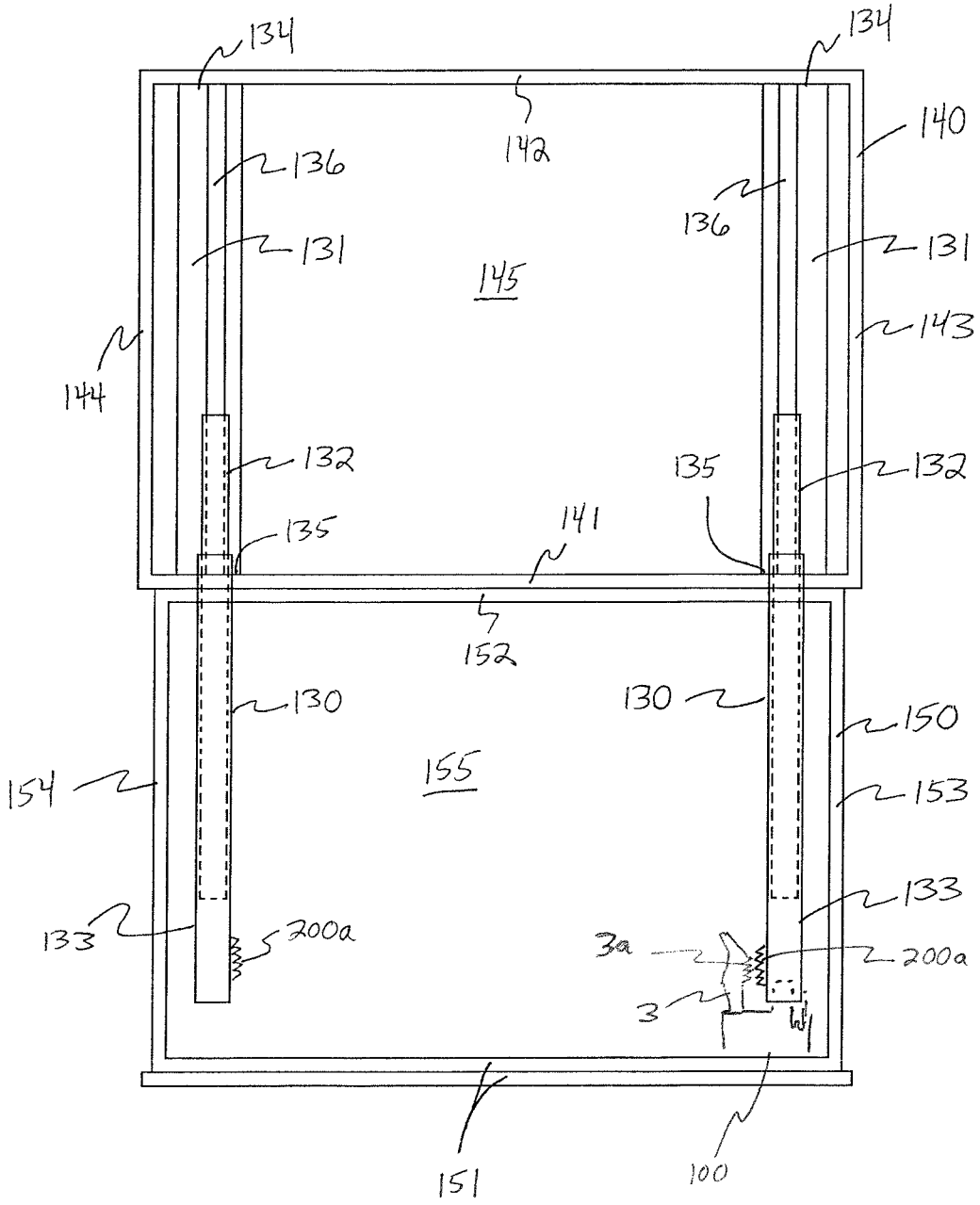

FIG. 16 is a schematic view depicting the arrangement as shown in FIG. 1 with one connector 100 (the right connector) inserted.

DETAILED DESCRIPTION OF THE INVENTIVE SUBJECT MATTER

The expression "adjacent," as used herein (e.g., in the expression "region adjacent to the tactile region") means the closest structural element, region or feature (e.g., the "region adjacent to the tactile region" is the structure that is closest to the tactile region).

The expression "engaged," as used herein, i.e., a first structure, element or component is "engaged" with a second structure, element or component (and related expressions, such as "engage," e.g., a first structure, element or component is configured to engage a second structure, element or component) (e.g., in the expression "the engagement element configured to releasably engage a drawer movement guide assembly"), means that a force of at least a threshold disengagement force would be required to cause the first structure, element or component to "disengage" from, i.e., to become free of the second structure, element or component, such that, e.g., with an engagement element releasably engaged with a drawer movement guide assembly, it is unlikely that the engagement element will become disengaged from the drawer movement guide assembly unless a deliberate action is taken to disengage the engagement element from the drawer movement guide assembly. There are a wide variety of ways to configure structures, elements or components such that they can be releasably engaged with each other, e.g., by providing teeth on the first element that engage with teeth on the second element, and all such ways are included in the present inventive subject matter.

The expression "attached," as used herein (e.g., in the expression "the base configured to be rigidly attached to a drawer"), means that the first structure, element or component that is "attached to" a second structure, element or component cannot be removed from the second structure without removing an attachment element (e.g., a screw or a bolt) or an attachment feature (e.g., screw-threading on one or both of the first and second structures, elements or components), or applying a significant force (much greater than the force required to "disengage" a structure, element or component from another structure, element or component). There are a wide variety of ways to configure structures, elements or components such that they are (or can be) attached to each other, e.g., by providing an opening on a first element and a threaded bore on a second element, such that a screw or bolt can extend through the first element and be threaded into the threaded bore on the second element, and all such ways are included in the present inventive subject matter.

The expression "rigidly attached," as used herein (e.g., in the expression "the base configured to be rigidly attached to a drawer"), means that the first structure that is "rigidly attached" to the second structure is attached to the second structure and moves with the second structure, i.e., by virtue of the rigid attachment, any movement that the second structure is caused to make causes the first structure to move similarly (and vice-versa, i.e., by virtue of the rigid attachment, any movement that the first structure is caused to make causes the second structure to move similarly).

The expression "on," as used herein (e.g., in the expression "a portion of a drawer that is on the first portion of the drawer movement guide assembly"), means that the first structure which is "on" a second structure can be in direct contact with the second structure, or can be separated from the second structure by one or more intervening structures (each side, or opposite sides, of which is/are in contact with the first structure, the second structure or one of the intervening structures).

The expression "parallel," as used herein, in relation to two lines, means that the two lines are both in the same plane, and do not share a point (and thus for each crossing line that is perpendicular to the lines that are parallel, the two points at which the crossing line intersect the two lines that are parallel are spaced the same distance).

The expression "parallel," as used herein, in relation to a plane and a line, means that the line and the plane do not share a point (and thus for each crossing line that is perpendicular to the plane and the line, the distance from (1) the point where the crossing line intersects the line, to (2) the point where the crossing line intersects the plane, is the same.

The expression "substantially parallel," as used herein (e.g., in the expression "the surface of the drawer front defining a plane that is substantially parallel to the first direction" or the expression "the adjustment element axis is substantially parallel to the first direction"), in relation to two lines, means that the two lines do not diverge from each other by more than 5 degrees (i.e., the lines could be made parallel by tilting one of the lines by 5 degrees or less); in relation to a line and a plane, means that the line does not diverge from the plane by more than 5 degrees (i.e., the line and the plane could be made parallel by tilting the line or the plane by 5 degrees or less);

The expression "substantially opposite direction," as used herein (e.g., in the expression "the second direction is an opposite direction to the first direction") means the second direction can be identical with the first direction by rotating the second direction between 175 degrees and 185 degrees.

The expression "perpendicular," as used herein in relation to a plane and an axis, means that the axis defines an angle of 90 degrees relative to the plane.

The expression "substantially perpendicular," as used herein in relation to a plane and an axis (e.g., in the expression "the engagement element pivot axis is substantially perpendicular to a plane in which the first direction extends") means that the axis could be made perpendicular to the plane by tilting the axis by not more than 5 degrees.

The expression "comprises" or "comprising," as used herein (e.g., in the expression "a connector, comprising: a base; a carriage; an adjustment element; and an engagement element"), is used in accordance with its well known usage, and means that the item that "comprises" the recited elements (or that is "comprising" the recited elements) includes at least the recited elements, and can optionally include any additional elements. For example, an item that is "comprising a base; a carriage; an adjustment element; and an engagement element" includes at least one base, at least one carriage, at least one adjustment element and at least one engagement element, i.e., it can include a single base or a plurality of bases (and likewise can include a single carriage or a plurality of carriages; can include a single adjustment element or a plurality of adjustment elements; and can include a single engagement element or a plurality of engagement elements).

The expression "direction," as used herein, means something that geometrically corresponds to a ray. Two different "directions" can be parallel to one another, even though they extend in the same compass direction (or in opposite compass directions). Two different directions can both be parallel to a particular line and extend in opposite compass directions.

The expression "extends," as used herein in the context of a direction means that every point in the ray to which the direction corresponds is reached by moving from the endpoint in the direction. Thus, e.g., the expression "a plane in which the first direction extends") means that every point in the ray to which the direction corresponds is also in the plane.

In the present specification, an expression that a first element is "movable" relative to a second element between a first position and a second position means that the first element can move (relative to the second element) from the first position to the second position, and can move from second position to the first position.

In the present specification, an expression that a first element is "pivotable" relative to a second element between a first position and a second position means that the first element can pivot, relative to a pivot axis extending through the second element, at least from a first pivot position to a second pivot position, and from the second pivot position to the first pivot position.

In the present specification, an expression that a first element is "linearly slidable" relative to a second element between a first position and a second position means that the first element can move (relative to the second element) in a straight direction and without any rotation, i.e., (1) the first element can slide (relative to the second element) from the first position to the second position (or any portion of such movement) and can slide (relative to the second element) from the second position to the first position (or any portion of such movement), and (2) in any such movement, the first element passes through each position between the starting point of such movement and the ending point of such movement, and (3) in any such movement, each point on the first element moves along only a respective line segment (defined relative to the second element) during an entirety of such movement, each of the respective line segments being parallel to each other (i.e., any line that is parallel to one of such line segments is parallel to all of them, and is parallel to each of the respective directions in which the line segments extend). A "direction" in which an element is "linearly slidable" is a direction that any of such line segments extends.

The present inventive subject matter encompasses many combinations of elements and features. The expression "In some embodiments in accordance with the present inventive subject matter, which can include or not include, as suitable, any of the other features described herein," or the like, is used in the present specification to introduce elements and/or features of the present inventive subject matter that can be included or not included in any particular embodiment, i.e., elements and/or features that can be combined in any suitable way. In other words, the present inventive subject matter encompasses all combinations of elements and/or features that are introduced with the expression "In some embodiments in accordance with the present inventive subject matter, which can include or not include, as suitable, any of the other features described herein," or the like.

As noted above, in accordance with the first and second aspects of the present inventive subject matter, there is provided a connector that comprises a base, a carriage, and an adjustment element, in which:

the base is configured to be rigidly attached to a drawer, the carriage is slidably attached to the base, movement of the adjustment element causes the carriage to slide relative to the base.

A base in accordance with the present inventive subject matter can be made of any suitable material or combination of materials. For example, an entirety of a base can be made of a single material or a single composition of materials, or different parts of a base can be made of different respective materials or compositions of materials. A wide variety of materials and compositions can be suitable in various situations, e.g., plastics (e.g., polypropylene, polyurethane, polyvinyl chloride, ABS, polyamide, polystyrene, polyethylene, polyoxymethylene, polycarbonate, polyethylene terephthalate, acrylonitrile styrene acrylate), metals (e.g., stainless steel, aluminum, copper, nickel, titanium), composite materials, etc.

A base in accordance with the present inventive subject matter can be of any suitable size and shape, so long as it is capable of having the desired properties and capabilities, e.g., as specified herein.

A carriage in accordance with the present inventive subject matter can be made of any suitable material or combination of materials, e.g., any of the materials described above in connection with a base. A carriage in accordance with the present inventive subject matter can be of any suitable size and shape, so long as it is capable of having the desired properties and capabilities, e.g., as specified herein.

An adjustment element in accordance with the present inventive subject matter can be made of any suitable material or combination of materials, e.g., any of the materials described above in connection with a base. An adjustment element in accordance with the present inventive subject matter can be of any suitable size and shape, so long as it is capable of having the desired properties and capabilities, e.g., as specified herein.

A base can be configured to be rigidly attached to a drawer in any of a wide variety of suitable ways, and any such ways are included in the present inventive subject matter. For example, a base can comprise one or more holes through which screws, bolts or nails can extend and connect to a drawer, and/or a base can have a surface that presents one or more regions that are situated in a plane, whereby such regions can be adhered to a drawer using an adhesive or a glue, and/or a base can have one or more recesses into which screws or bolts can extend (in addition to extending through holes in a drawer), and/or a base can comprise one or more flanges that slips over one or more corresponding flange-retaining structures attached to a drawer, and/or a base can comprise one or more clips that are releasably receivable in one or more receptacles on a drawer, and/or a base can comprise one or more receptacles into which one or more clips on a drawer are releasably receivable, etc.

A carriage can be slidably attached to a base in any of a wide variety of suitable ways, and any such ways are included in the present inventive subject matter. For example, a carriage can have one or more structures that define one or more spaces within which one or more corresponding structures on a base can move, and/or a base can have one or more structures that define one or more spaces within which one or more corresponding structures on a carriage can move, and in some instances, each of the structures is configured such that multiple combinations of structures each guide movement of a carriage relative to a base in substantially the same direction.

There are a wide variety of ways that a carriage, a base and an adjustment element can be configured such that movement of the adjustment element causes the carriage to slide relative to the base. For example, one way is for the carriage to have a threaded protrusion that has external threads that thread with internal threads on the adjustment element, and for the adjustment element to be rotatably mounted on the base, such that rotating the adjustment element about an axis causes the threaded protrusion of the carriage to move along the axis. Another representative way is for the carriage to have a threaded recess (or opening) that has internal threads that thread with external threads on the adjustment element, and for the adjustment element to be rotatably mounted on the base, such that rotating the adjustment element about an axis causes the threaded protrusion of the carriage to move along the axis (and thus causes the carriage to move in a direction along the axis).

In some embodiments according to the present inventive subject matter, which can include or not include, as suitable, any of the other features described herein, the connector comprises an engagement element which is configured to releasably engage a drawer movement guide assembly. An engagement element in accordance with the present inventive subject matter can be made of any suitable material or combination of materials, e.g., any of the materials described above in connection with a base. An engagement element in accordance with the present inventive subject matter can be of any suitable size and shape, so long as it is capable of having the desired properties and capabilities, e.g., as specified herein. There are a wide variety of suitable ways in which an engagement element can releasably engage a drawer movement guide assemblies, and all such ways are included in the present inventive subject matter. In some of such embodiments, for example, the engagement element comprises engagement element teeth, the drawer movement guide assembly comprises an engagement region, and the engagement element is resilient (and/or comprises a resilient region) and it is configured to bias the engagement element toward an engagement position (i.e., a position in which at least one of the engagement element teeth of the engagement element is/are engaged with the engagement region of the drawer movement guide assembly), upon the engagement element being moved to a disengagement position (i.e., a position in which the engagement element teeth of the engagement element are not engaged with the engagement region of the drawer movement guide assembly).

In some embodiments according to the present inventive subject matter, which can include or not include, as suitable, any of the other features described herein, the connector comprises an engagement element which is configured to releasably engage a drawer movement guide assembly, the engagement element is a separate structure from the carriage, the engagement element is pivotally attached to the carriage, and the engagement element is pivotable relative to the carriage about an engagement element pivot axis.

In some embodiments according to the present inventive subject matter, which can include or not include, as suitable, any of the other features described herein, the connector comprises an engagement element which is configured to releasably engage a drawer movement guide assembly, the engagement element and the carriage are a one-piece structure, the engagement element comprises a resilient portion that is configured to abut an abutment region of the carriage and pivotally bias the engagement element toward an engagement position, upon the engagement element being moved to a disengagement position.

In some embodiments according to the present inventive subject matter, which can include or not include, as suitable, any of the other features described herein, the connector comprises an engagement element which is configured to releasably engage a drawer movement guide assembly, the engagement element comprises a tactile region and a region adjacent to the tactile region, an extremity of the tactile region is in a first plane, the first plane is to a first side of a second plane, all portions of the region adjacent to the tactile region are to a second side of the second plane, and the first plane and the second plane are substantially perpendicular to the first direction. In some of such embodiments, the connector is configured to be attached to a drawer, with one side of the connector facing the drawer (e.g., relatively close to the bottom of the drawer), and a tactile region projects from the opposite side of the connector away from the drawer, such that the tactile region is readily accessible and easy to actuate.

In some embodiments according to the present inventive subject matter, which can include or not include, as suitable, any of the other features described herein, the carriage is linearly slidable, in a first direction, from a carriage first position to a carriage second position, the carriage is linearly slidable, in a second direction, from the carriage second position to the carriage first position, the second direction is a substantially opposite direction to the first direction (i.e., the carriage can be slid back and forth), the connector comprises an engagement element that is pivotally attached to the carriage, and the axis about which the engagement element pivots is substantially perpendicular to a first plane in which the first direction extends.

In some embodiments according to the present inventive subject matter, which can include or not include, as suitable, any of the other features described herein, the carriage further comprises a carriage positioning region, the carriage positioning region is configured to engage with a drawer movement guide assembly, and sliding the carriage causes the engagement element and the carriage positioning region to move relative to the base. A carriage positioning region can be made of any suitable material (e.g., any of the materials described above for the carriage). A carriage positioning region and the carriage can be a one-piece structure or the carriage positioning region can be attached to the carriage. A carriage positioning region can be configured to engage with a drawer movement guide assembly in any of a wide variety of suitable ways (e.g., the carriage positioning region can comprise a protrusion that fits within a rail of a drawer movement guide assembly, and/or the carriage positioning region can comprise a recess in which a rail of a drawer movement guide assembly (or any other part of a drawer movement guide assembly) can fit), and all such ways are included in the present inventive subject matter.

In some embodiments according to the present inventive subject matter, which can include or not include, as suitable, any of the other features described herein, the connector comprises a wedge element, the wedge element is configured to cause a change in a spacing between a first portion of a drawer movement guide assembly and a portion of a drawer that is on the first portion of the drawer movement guide assembly, by the wedge element being moved.

In some embodiments according to the present inventive subject matter, which can include or not include, as suitable, any of the other features described herein, the connector comprises a wedge element, the wedge element is movably attached to the carriage, and the wedge element is configured to cause a change in a spacing between a first portion of a drawer movement guide assembly and a portion of a drawer that is on the first portion of the drawer movement guide assembly, by the wedge element being moved relative to the carriage.

In some embodiments according to the present inventive subject matter, which can include or not include, as suitable, any of the other features described herein, the connector comprises a wedge element, the wedge element is slidably attached to the carriage and linearly slidable relative to the carriage between a wedge element first position and a wedge element second position, and the wedge element is configured to cause a change in a spacing between a first portion of a drawer movement guide assembly and a portion of a drawer that is on the first portion of the drawer movement guide assembly by the wedge element being moved from the wedge element first position to the wedge element second position.

In some embodiments according to the present inventive subject matter, which can include or not include, as suitable, any of the other features described herein:

the connector comprises a wedge element, the wedge element is slidably attached to the carriage, the carriage is linearly slidable, in a first direction, from a carriage first position to a carriage second position, the carriage is linearly slidable, in a second direction, from the carriage second position to the carriage first position, the second direction is a substantially opposite direction to the first direction, the base is configured to be attached to a surface of a drawer front, the surface of the drawer front defining a drawer front plane that is substantially parallel to the first direction, the wedge element is linearly slidable relative to the carriage in a third direction from a wedge element first position to a wedge element second position, the third direction is substantially perpendicular to the drawer front plane, the wedge element is linearly slidable relative to the carriage in a fourth direction from the wedge element second position to the wedge element first position, the fourth direction is a substantially opposite direction to the third direction, and the wedge element is configured to cause a change in a spacing between a first portion of a drawer movement guide assembly and a portion of a drawer that is on the first portion of the drawer movement guide assembly by the wedge element being moved from the wedge element first position to the wedge element second position.

In some embodiments according to the present inventive subject matter, which can include or not include, as suitable, any of the other features described herein, the connector comprises a wedge element, the wedge element is slidably attached to the carriage and linearly slidable relative to the carriage between a wedge element first position and a wedge element second position, and the wedge element is configured to cause a change in a spacing between a first portion of a drawer movement guide assembly and a portion of a drawer that is on the first portion of the drawer movement guide assembly by the wedge element being moved from the wedge element first position to the wedge element second position, and the wedge element comprises at least one incremental movement structural feature that is configured to facilitate incremental sliding movement of the wedge element between the wedge element first position and the wedge element second position, and thereby provide incremental changes in the spacing between said portion of a drawer movement guide assembly and said portion of a drawer that is on the portion of the drawer movement guide assembly.

In some embodiments according to the present inventive subject matter, which can include or not include, as suitable, any of the other features described herein, the connector further comprises a wedge element, the wedge element is pivotally attached to the carriage and is pivotable relative to the carriage between a wedge element first pivot position and a wedge element second pivot position, and the wedge element is configured, upon being moved from the wedge element first position to the wedge element second position, to cause a change in a spacing between a portion of a drawer movement guide assembly and a portion of a drawer that is on the portion of the drawer movement guide assembly. In some of such embodiments, (1) the wedge element comprises at least one incremental movement structural feature that is configured to facilitate incremental pivoting movement of the wedge element between the wedge element first pivot position and the wedge element second pivot position, and thereby provide incremental changes in the spacing between said portion of a drawer movement guide assembly and said portion of a drawer that is on the portion of the drawer movement guide assembly, and optionally also (2) the wedge element comprises a pressing plate that is configured to cause the incremental movement structural feature to disengage with a restricting structure attached to the carriage upon the pressing plate being pressed in a direction toward the incremental movement structural feature (e.g., the connector is configured to be attached to a drawer, with one side of the connector facing the drawer (e.g., relatively close to the bottom of the drawer), and a pressing plate projects from the opposite side of the connector away from the drawer and has a relatively large surface area (in some instances including grooves or other surface features to enhance friction and/or to help a user recognize that he or she is touching the pressing plate, e.g., without being able to see it) facing away from the connector, such that the pressing plate region is readily accessible and easy to actuate).

In some embodiments according to the present inventive subject matter, which can include or not include, as suitable, any of the other features described herein:

- the engagement element and the carriage are separate structures,
- the engagement element is pivotally attached to the carriage, and
- the engagement element is pivotable relative to the carriage about an engagement element pivot axis,
- the carriage is linearly slidable, in a first direction, from a carriage first position to a carriage second position,
- the carriage is linearly slidable, in a second direction, from the carriage second position to the carriage first position,
- the second direction is a substantially opposite direction to the first direction, and
- the engagement element pivot axis is substantially perpendicular to a first plane in which the first direction extends.

In some embodiments according to the present inventive subject matter, which can include or not include, as suitable, any of the other features described herein:

- the engagement element and the carriage are separate structures,
- the engagement element is pivotally attached to the carriage, and
- the engagement element is pivotable relative to the carriage about an engagement element pivot axis.
- the carriage is linearly slidable, in a first direction, from a carriage first position to a carriage second position,
- the carriage is linearly slidable, in a second direction, from the carriage second position to the carriage first position,
- the second direction is a substantially opposite direction to the first direction,
- the base is configured to be attached to a surface of a drawer front, the surface of the drawer front defining a drawer front plane that is substantially parallel to the first direction, and
- the engagement element pivot axis is substantially perpendicular to a first plane in which the first direction extends.

In some embodiments according to the present inventive subject matter, which can include or not include, as suitable, any of the other features described herein:

- the carriage is linearly slidable, in a first direction, from a carriage first position to a carriage second position,
- the carriage is linearly slidable, in a second direction, from the carriage second position to the carriage first position,
- the second direction is a substantially opposite direction to the first direction, and
- the base is configured to be attached to a surface of a drawer front, the surface of the drawer front defining a drawer front plane that is substantially parallel to the first direction,
- whereby linearly sliding the carriage in the first direction or in the second direction causes the engagement element to move relative to the base.

As noted above, in accordance with a third aspect of the present inventive subject matter, there is provided a connector that comprises a connector assembly and an engagement element, in which:

- a first portion of the connector assembly is configured to be rigidly attached to a drawer,
- the engagement element is configured to releasably engage a drawer movement guide assembly,
- the engagement element is a separate structure from the connector assembly,
- the engagement element is pivotally attached to the connector assembly, and
- the engagement element is pivotable relative to the connector assembly about an engagement element pivot axis.

The connector assembly in a connector in accordance with the third aspect of the present inventive subject matter can be made of any suitable material or combination of materials, e.g., any of the materials described above in connection with a base. A connector assembly in accordance with the present inventive subject matter can be of any suitable size and shape, so long as it is capable of having the desired properties and capabilities, e.g., as specified herein.

In some embodiments according to the third aspect of the present inventive subject matter, which can include or not include, as suitable, any of the other features described herein, the connector assembly comprises a base, a carriage and an adjustment element, the first portion of the connector assembly is part of the base, the carriage is slidably attached to the base, and movement of the adjustment element causes the carriage to slide relative to the base. In such embodiments, the base, the carriage and the adjustment element can have any of the features and characteristics as described above for bases, carriages and adjustment elements, and the carriage can be slidably attached to the base in any of the ways described above.

The engagement element in a connector in accordance with the third aspect of the present inventive subject matter can have any of the features and characteristics as described above for the first and second aspects of the present inventive subject matter.

The first portion of the connector assembly is configured to be rigidly attached to a drawer in any of the ways described herein for attaching a component to a drawer.

The engagement element can be configured to releasably engage a drawer movement guide assembly in any of the ways described herein for an engagement element to releasably engage a drawer movement guide assembly.

In some embodiments according to the third aspect of the present inventive subject matter, which can include or not include, as suitable, any of the other features described herein, the engagement element is pivotally attached to the carriage, and the engagement element is pivotable relative to the carriage about an engagement element pivot axis.

The present inventive subject matter is also directed to systems that comprise a connector as described herein and a drawer movement guide assembly.

The present inventive subject matter is also directed to systems that comprise a connector as described herein and a cabinet.

The present inventive subject matter is also directed to systems that comprise a connector as described herein and a drawer.

The present inventive subject matter is also directed to systems that comprise a connector as described herein, a drawer movement guide assembly and a cabinet.

The present inventive subject matter is also directed to systems that comprise a connector as described herein, a cabinet and a drawer.

The present inventive subject matter is also directed to systems that comprise a connector as described herein, a drawer movement guide assembly and a drawer.

The present inventive subject matter is also directed to systems that comprise a connector as described herein, a drawer movement guide assembly, a cabinet and a drawer.

Embodiments in accordance with the present inventive subject matter are described herein in detail in order to provide exact features of representative embodiments that are within the overall scope of the present inventive subject matter. The present inventive subject matter is not limited to such detail.

FIG. 1 is a schematic drawing depicting an overhead view (with the top of the cabinet 140 removed) of a representative example of a pair of drawer movement guide assemblies 130 which are attached to a representative example of a cabinet 140 and which support a representative example of a drawer 150. Referring to FIG. 1, each drawer movement guide assembly 130 comprises a track 131, a first rail 132 and a second rail 133. The cabinet 140 comprises a front cabinet panel 141, a rear cabinet panel 142, a right side cabinet panel 143, a left side cabinet panel 144 and a bottom cabinet panel 145. Each track 131 comprises a first end 134 (which is attached to the rear panel 142 of the cabinet 140), a second end 135 (which is attached to the front panel 141 of the cabinet 140), and a rail support 136. In each drawer movement guide assembly 130, the first rail 132 is supported on the rail support 136 and is telescopically slidable on the rail support 136. In each drawer movement guide assembly 130, the second rail 133 is supported on the first rail 132 and is telescopically slidable on the first rail 132. Each second rail 133 comprises an engagement region 200*a* (with which, as discussed below, in a representative embodiment, engagement element teeth 3*a* of an engagement element 3 selectively engage). The drawer 150 comprises a front drawer panel 151, a rear drawer panel 152, a right side drawer panel 153, a left side drawer panel 154 and a bottom drawer panel (the bottom drawer panel is removed in this view to enable the second rails 133 and the engagement regions 200*a* to be seen, but it would be in the location identified with reference number 155).

Figure 2:
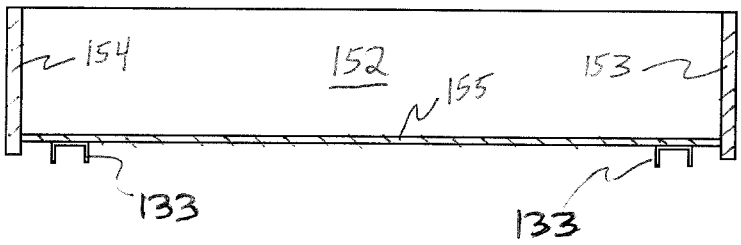
FIG. 2 is a sectional view taken along the plane 2-2 in FIG. 1.

FIG. 2 is a sectional view taken along the plane 2-2 in FIG. 1 (the bottom drawer panel 155 is shown in this view). Referring to FIG. 2, the drawer 150 rests on the respective second rails 133 of the drawer movement guide assemblies 130.

In the arrangement depicted in FIG. 2, there is space between the right second rail 133 and the right side drawer panel 153, and there is space between the left second rail 133 and the left side drawer panel 154. These spaces can be reduced or eliminated (i.e., the right second rail 133 can be in contact with the right side drawer panel 153 and/or the left second rail 133 can be in contact with the left side drawer panel 154) in order to restrict more closely the side-to-side movement of the drawer 150 relative to the drawer movement guide assemblies 130 (and thus relative to the cabinet 140).

Figure 3:
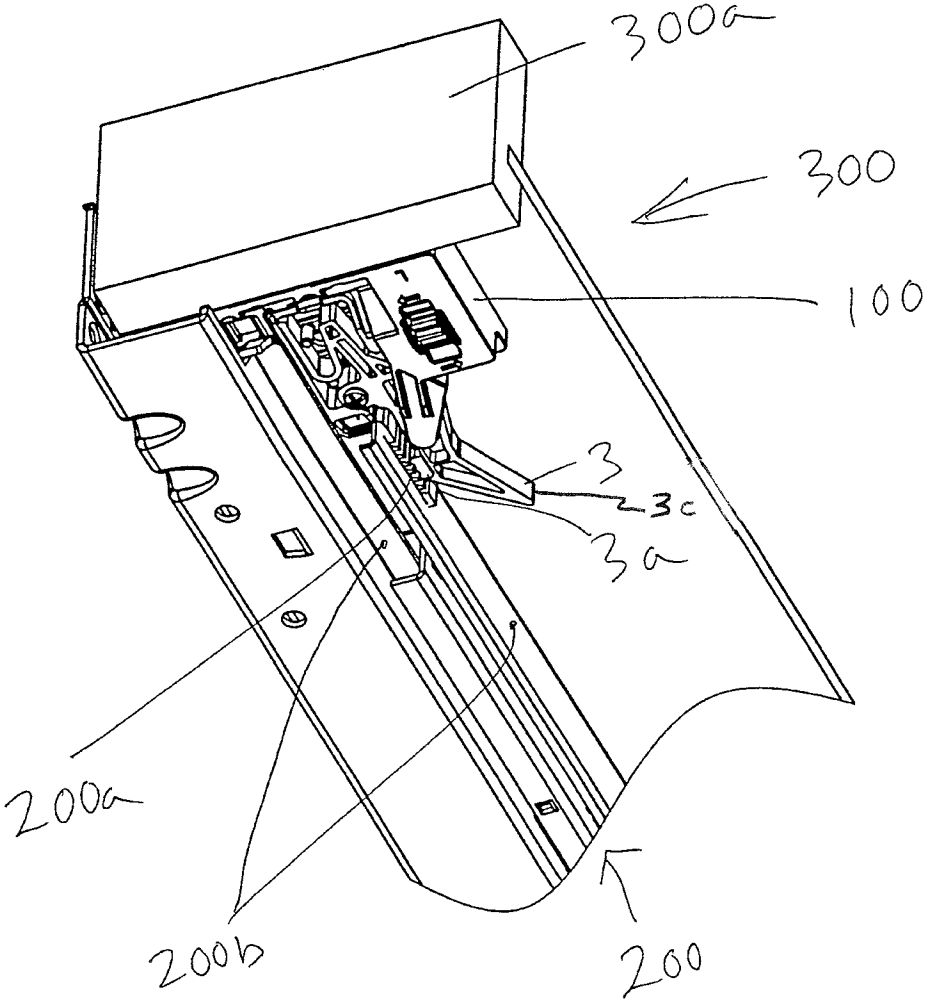
FIG. 3 shows a connector 100 according to a first embodiment of the present invention installed on the bottom forward portion of a drawer 300.

FIG. 3 shows a connector 100 according to a first embodiment of the present invention installed on the bottom forward portion of a drawer 300. The connector 100 includes an engagement element in the form of a latching portion 3 that has engagement element teeth 3*a* that engage with an engagement region on a drawer movement guide assembly in the form of teeth 200*a* on a drawer rail 200*b* of a drawer movement guide assembly 200 (e.g., a Grass Elite drawer slide). The drawer movement guide assembly shown in FIG. 3 is similar to the drawer movement guide assembly shown in FIGS. 1 and 2. The latching portion 3 is biased (e.g., resiliently or with a spring) to move to a position where the teeth 3*a* engage with the teeth 200*a*, and the latching portion 3 can be manually retracted and released to selectively engage the front of the drawer 300 with the drawer rail 200*b*. For example, in this embodiment, the latching portion 3 can be manually retracted by applying pressure to the remote end 3*c* of the arm of the latching portion on which the teeth 3*a* are provided, i.e., by pushing on the same protrusion from the pivot point as the teeth 3*a*, at a location that is farther from the pivot point than the teeth 3*a*, providing easy access and excellent leverage for the user.

Figure 4:
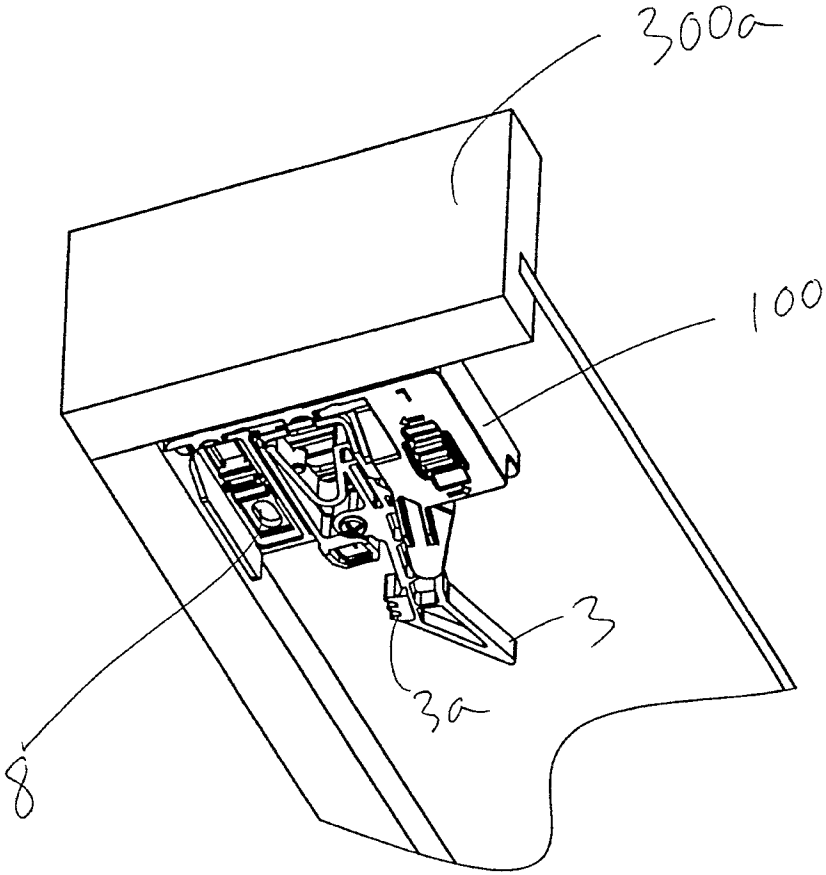
FIG. 4 shows the connector 100 without the drawer movement guide assembly 200 in place.

FIG. 4 shows the connector 100 without the drawer movement guide assembly 200 in place. The connector 100 depicted in FIGS. 3 and 4 is for the left, bottom forward portion of a drawer (note the L shown on the device). A connector for the right side of the drawer is essentially a mirror image structure of the connector 100 shown in FIGS. 3 and 4. As will be explained in greater detail below, the connector 100 includes a wedge element 8 that is displaceable between the bottom of the drawer and the forward terminal end of the drawer rail 200*b* to allow for vertical adjustment of the drawer front 300*a* relative to the drawer rail 200*b*.

FIGS. 5 and 6 are exploded views of representative embodiments of connectors in accordance with the present inventive subject matter. The connectors depicted in FIGS. 5 and 6 are respectively designed for the right and left, bottom forward portions of a drawer (note R and L shown on each device). Each connector has a base 1 that has mounting holes 1*a* for securing the base 1 to the bottom forward portion of the drawer 300, as shown in FIGS. 3 and 4. The base 1 has a slot 4 and two pairs of downwardly protruding locking fingers 4*a*. One pair of locking fingers is arranged on each side of the slot 4, with only one pair of locking fingers being viewable in FIGS. 5 and 6. At the bottom of each finger, there is a hook 4*b* (FIG. 7), the function of which will be explained below.

Figure 7:
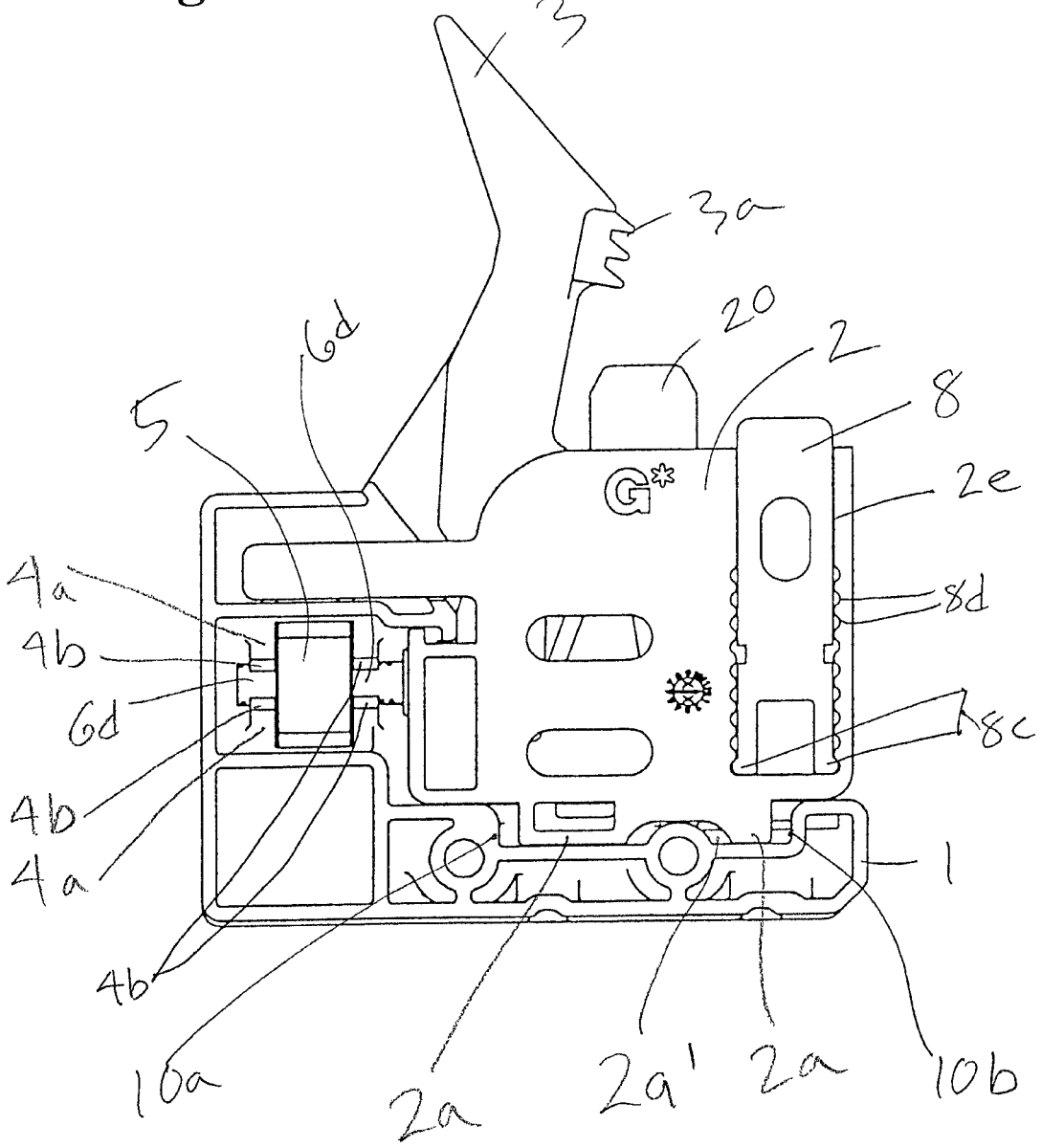
FIG. 7 is a bottom view of the right-side connector shown in FIG. 5.

Each connector also includes a carriage 2 that has a rail 2*a*, which rides in a slot 2*a*' (see FIG. 7) in the bottom of the base 1 to ensure linear sliding movement between the base 1 and the carriage 2. The carriage 2 also includes a post 6 having a carriage threaded region in the form of top threads 6*a* along its top and bottom threads 6*b* partially along its bottom, as well as flat sides 6*c*, and flat bottom portions 6*d* (FIG. 7). The locking fingers 4*a* spread and snap past the flat sides 6*c* so that the hooks 4*b* at the bottom of the fingers 4*a* engage flat bottom surfaces 6*d* of the post 6 where the bottom threads 6*b* do not exist. This engagement provides one of the snap-fit engagements between the base 1 and the carriage 2 to hold these two parts together.

An adjustment element (in the form of a thumb wheel 5) has an internal adjustment element threaded region which is threaded on the threaded region of the post 6, and an upper portion of the thumb wheel extends in an accessible manner above the slot 4. The sides 5*a*, 5*b* of the thumb wheel 5 abut respective sides 4*c*, 4*d* of the slot 4, such that, when the thumb wheel 5 is rotated about an axis 5*c* (an adjustment element axis), it is prevented from moving along the axis 5*c* by the sides of the thumb wheel 5 abutting the sides of the slot 4, and so the threading causes the post 6 (and thus the carriage 2) to slide relative to the base 1 in a linear manner. This allows for left-right adjustment of each connector after it is already attached to the bottom forward portion of the drawer 300 to account for slight variations in manufacturing tolerances of the drawer and the associated cabinetry. As such, the drawer front 300*a* can be moved left or right so that it matches the spacing of adjacent cabinetry components.

The latching portion 3 having the teeth 3*a* is attached to the carriage 2 by a screw 7, and the latching portion 3 is pivotable about an engagement element pivot axis coaxial with the screw (i.e., the latching portion 3 and the carriage 2 are separate structures). Because the latching portion 3 is rotatably attached to the carriage, the latching portion 3 moves left or right as the carriage 2 moves left or right. In this embodiment, the latching portion 3 includes a resilient portion 3*b* positioned between an abutment region (in the form of a wall 2*c*) and a post 2*d* on the carriage 2 to provide the necessary biasing to ensure that the teeth 3*a* of the latching portion 3 securely engage the teeth 200*a* on the drawer rail 200*b* when no external force is being applied to the connector (alternatively, other biasing structure can be provided, e.g., a spring).

Each connector also includes a wedge element 8 that is retained within a slot 2*e* (FIG. 7) in the carriage 2 such that the wedge element is displaceable in a direction perpendicular to the left-right adjustment direction explained above. The wedge element 8 includes a ramped surface 8*a* that can be caused to slide between the bottom surface of the drawer and a top surface of the drawer rail 200*b* such that, when the wedge element 8 is moved away from the forward rail 2*a*, the wedge element 8 provides vertical adjustment of the carriage 2, which in turn provides vertical adjustment of the drawer front 300*a*. The wedge element 8 includes exposed protrusions 8*b* that provide a gripping surface for a user to move the wedge element 8. The middle protrusion includes snap-fit hooks 8*c* on either end thereof for engaging an upper groove 2*f* in slot 2*e* so that the wedge element can be retained in the slot in a longitudinally displaceable manner (i.e., the distance between the distal ends of the snap-fit hooks 8*c* is greater than the width of the groove 2*f*).

FIGS. 5-7 also show that the carriage 2 includes a carriage positioning region (in the form of a drawer rail engagement member 20) that extends into the forward terminal end of the drawer rail 200*b*. Since the drawer rail engagement member 20 is an integral part of the carriage 2, as the carriage 2 is adjusted left or right relative to the base 1, the drawer 300, and thus the drawer front 300*a*, is also adjusted left or right.

FIG. 7 is a bottom view of the right-side connector shown in FIG. 5. FIG. 7 shows the hooks 4*b* of the locking fingers 4*a* engaging the flat bottom surfaces 6*d* of the post 6. Again, this engagement is a snap-fit engagement that holds the base 1 to the carriage 2. There is another snap-fit engagement 2*g* (FIGS. 5-6) on the carriage 2 having an upper hook that engages a slot in a corresponding area on the base 1. These two snap-fit engagements are all that is necessary to hold the base 1 and carriage 2 to one another, which makes for very efficient assembly of the overall device.

FIG. 7 also shows the left and right ends of the rail 2*a* which abut stops 10*a* and 10*b* of the base 1, respectively, to limit the linear displacement of the carriage 2 relative to the base 1.

FIG. 7 also shows incremental movement structural features (in the form of protrusions 8*e*) of the wedge element 8 engaging corresponding recesses 8*d* in the carriage 2. The protrusions 8*e* have enough resiliency that, once the wedge element 8 is displaced to a desired position, they hold the wedge element in that position until manually moved again.

FIGS. 8A and 8B are bottom views showing the right-most and left-most relative positions of the carriage 2 and the base 1 by actuation of the thumb wheel 5.

FIGS. 9A-9D are perspective views of a left-side connector, a right-side connector, another left-side connector with a flange 30 and another right-side connector with a flange 30. The flange 30 allows the connector to be mounted on the bottom of the drawer front 300*a*, as opposed to being mounted to the back side of the drawer front 300*a* as depicted in FIGS. 3 and 4.

FIGS. 10 and 11 show another embodiment of right-side and left-side connectors, respectively, according to a second embodiment of the present invention. Like reference numbers indicate like functioning parts in all drawings.

A main difference between the first and second embodiments is that in the second embodiment the wedge element 8 takes the shape of an arc-shaped wedge element 8B that has a ramp surface 8*a*B that performs the same function as the ramp 8*a* in the first embodiment (i.e., it can be moved between the bottom surface of the drawer and the top surface of the forward terminal end of the drawer rail 200*b* to provide for vertical adjustment of the drawer front 300*a*). The arc-shaped wedge element 8B is rotated about a connection axis 38 to provide for vertical adjustment of the connector. The arc-shaped wedge element 8B is pivotally connected to the carriage 2 by a pair of protrusions 39 (with hooks 39*a* on their distal ends) that are attached to the carriage 2 and that extend through an opening 40 in the arc-shaped wedge element 8B, such that the hooks 39*a* extend to locations outside the opening 40 on the opposite side of the arc-shaped wedge element 8B (see FIG. 12A), thereby pivotally holding the arc-shaped wedge element 8B in place relative to the carriage 2. The carriage 2 also has a guide protrusion 41 (see FIG. 12A) that extends into an arc-shaped opening 42 in the arc-shaped wedge element 8B, thereby guiding the pivoting movement of the arc-shaped wedge element 8B relative to the carriage 2. A pressing plate 31 is provided on the end of a resilient lever member 37 that extends upwardly at an angle from a base portion 32 of the arc-shaped wedge element 8B and that has an incremental movement structural feature (in the form of a tooth 33) that engages a restricting structure (in the form of teeth 34) formed on an arc-shaped region 35 of the carriage 2. The pressing plate 31 can be pushed down and moved within arc-shaped slot 36 in the carriage 2 to change the engagement position between the tooth 33 on the lever member 37 and the teeth 34 formed along the arc-shaped slot 36 of the carriage 2. By changing the position of the lever member 37 within the arc-shaped slot 36, more or less of the ramp surface 8*a*B is interposed between the bottom surface of the drawer and the top surface of the drawer rail 200*b* to provide for vertical adjustment of the drawer front 300*a*. In this embodiment, with the connector installed, the pressing plate 31 projects from the opposite side of the connector away from the drawer and has a relatively large surface area (in some instances including grooves or other surface features to enhance friction and/or to help a user recognize that he or she is touching the pressing plate 31, e.g., without being able to see it) facing away from the connector, such that the pressing plate 31 is readily accessible and easy to actuate.

The carriage 2 in FIG. 10 comprises a drawer rail engagement member 20 and a pair of flexible elements 20' which are flexible, and which provide tolerances for variances in the exact length of the drawer relative to the exact length of the drawer movement guide assemblies (e.g., rails). Each of FIGS. 12A and 12B similarly depicts a drawer rail engagement member 20 and a pair of flexible elements 20'.

Another difference between the first and second embodiments is that in the second embodiment the engagement element (in the form of a latching portion 3) and the carriage 2 are both part of a one-piece structure. In this embodiment, the latching portion 3 comprises at least one resilient region, and the latching portion 3 (and its teeth 3*a*) is resiliently biased toward engagement with the teeth 200*a* on the drawer rail 200*b* position upon the engagement element being bent such that the teeth 3*a* are disengaged from the teeth 200*a*.

FIGS. 12A and 12B are bottom views showing the right-most and left-most relative positions of the carriage 2 and the base 1 (i.e., a carriage first position and a carriage second position, between which the carriage is linearly-slidable relative to the base 1 by back-and-forth movement relative to the base, i.e., movement in a first direction and movement in a second direction, the second direction opposite to the first direction, by actuation of the thumb wheel 5).

FIG. 13A is a bottom, exploded perspective view of the connector shown in FIG. 5, and FIG. 13B is a bottom, exploded perspective view of the connector shown in FIG. 6.

FIG. 14A is a bottom, exploded perspective view of the connector shown in FIG. 10, and FIG. 14B is a bottom, exploded perspective view of the connector shown in FIG. 11.

FIG. 15 depicts another embodiment of a connector in accordance with the present inventive subject matter. The connector depicted in FIG. 15 is identical to the connector depicted in FIG. 6, except that the connector in FIG. 15 comprises a tactile region 160 (part of the latching portion 3, i.e., the latching portion 3 and the tactile region 160 are a one-piece structure). The tactile region 160 provides a surface with which a user can easily apply force to the latching portion 3 to move it to a position where the teeth 3*a* do not engage with the teeth 200*a* on the drawer movement guide assembly. In this embodiment, the tactile region 160 is on an arm of the latching portion 3 that extends (relative to the pivot axis) in a direction that is different from the direction in which the arm of the latching portion 3 on which the teeth are formed extends (relative to the pivot axis), thereby providing easy access and excellent leverage for the user. In this embodiment, with the connector installed, one side of the connector faces the drawer (and might be relatively close to the bottom of the drawer), and a tactile region projects from the opposite side of the connector away from the drawer, such that the tactile region is readily accessible and easy to actuate.

FIG. 16 is a schematic view depicting the arrangement as shown in FIG. 1 with one connector 100 (the right connector) inserted. FIG. 16 shows the teeth 3*a* of the engagement element 3 engaged with the teeth 200*a* on the drawer movement guide assembly. In this embodiment, a left connector (a mirror image of the connector 100) would be provided to engage with the left drawer movement guide assembly. By pivoting the right engagement element counter-clockwise and pivoting the left engagement element clockwise, the teeth 3*a* of each engagement element can be disengaged from the respective teeth 200*a*, enabling the drawer 150 to be slid forward, away from the drawer movement guide assemblies and away from the rear panel 142 of the cabinet 140 (i.e., downward in the page of the depiction in FIG. 16), while still being supported by the drawer movement guide assemblies, and then the drawer 150 can be lifted off of the drawer movement guide assemblies (i.e., out of the page in the depiction in FIG. 16), such that the drawer 150 is free from the drawer movement guide assemblies and free from the cabinet. The drawer 150 can be installed relative to the cabinet by performing the reverse sequence of actions, i.e., by placing the drawer 150 on the drawer movement guide assemblies and pushing the drawer 150 toward the rear cabinet panel 142. In this embodiment, as the drawer 150 is pushed toward the rear cabinet panel 142, upon the engagement elements 3 coming into contact with the drawer movement guide assemblies, the engagement elements push the second rail 133 toward the rear cabinet panel 142, causing the second rail 133 to move (telescoping relative to the first rail 132) toward the rear panel 142 and causing the first rail 132 to move (telescoping relative to the rail support 136) toward the rear panel 142, until the first rail 132 reaches the farthest position toward the rear cabinet panel 142 that it can reach relative to the rail support 136 (this position can be set by any suitable structure or structures, e.g., stop elements that restrict the telescoping movement of the first rail 132 relative to the rail support 136) and the second rail 133 reaches the farthest position toward the rear cabinet panel 142 that it can reach relative to the first rail 132 (this position can be set by any suitable structure or structures, e.g., stop elements that restrict the telescoping movement of the second rail 133 relative to the first rail 132), after which further pushing the drawer 150 toward the rear cabinet panel causes the biased engagement elements 3 to pivot away from the respective drawer movement guide assemblies (i.e., the right engagement element pivots counter-clockwise and the left engagement element pivots clockwise), until the drawer 150 is pushed no further (or is pushed fully into the cabinet 140), upon which the biasing pivots the engagement elements 3 toward the respective drawer movement guide assemblies, whereby the teeth 3*a* on the engagement elements 3 engage with the teeth 200*a* on the drawer movement guide assemblies.

Many alterations and modifications may be made by those having ordinary skill in the art, given the benefit of the present disclosure, without departing from the spirit and scope of the inventive subject matter.

Each component described herein can be a unitary one-piece structure. In some cases, if suitable, two or more structural parts of the devices described herein can be integrated, and/or a component can be provided in two or more parts (which are held together, if necessary).

The invention claimed is:

1. A connector, comprising:

a base;

a carriage;

an adjustment element; and an engagement element, the base is configured to be rigidly attached to a drawer, the carriage comprises a post, the adjustment element is mounted on the post, the base comprises locking fingers that engage the post on opposite sides of the adjustment element, the carriage is slidably attached to the base, movement of the adjustment element causes the carriage to slide relative to the base, the engagement element is configured to releasably engage a drawer movement guide assembly, the engagement element is attached to the carriage, whereby sliding the carriage causes the engagement element to move relative to the base.

2. A connector as recited in claim 1, wherein:

the carriage further comprises a carriage positioning region, the carriage positioning region is configured to engage with a drawer movement guide assembly, and sliding the carriage causes the engagement element and the carriage positioning region to move relative to the base.

3. A connector as recited in claim 1, wherein:
the engagement element and the carriage are separate structures,
the engagement element is pivotally attached to the carriage, and
the engagement element is pivotable relative to the carriage about an engagement element pivot axis.

4. A connector as recited in claim 3, wherein:
the engagement element comprises a resilient portion that is configured to abut an abutment region of the carriage and pivotally bias the engagement element toward an engagement position, upon the engagement element being pivoted to a disengagement position.

5. A connector as recited in claim 3, wherein:
the carriage is linearly slidable, in a first direction, from a carriage first position to a carriage second position,
the carriage is linearly slidable, in a second direction, from the carriage second position to the carriage first position,
the second direction is a substantially opposite direction to the first direction, and
the engagement element pivot axis is substantially perpendicular to a first plane in which the first direction extends.

6. A connector as recited in claim 3, wherein:
the carriage is linearly slidable, in a first direction, from a carriage first position to a carriage second position,
the carriage is linearly slidable, in a second direction, from the carriage second position to the carriage first position,
the second direction is a substantially opposite direction to the first direction,
the base is configured to be attached to a surface of a drawer front, the surface of the drawer front defining a drawer front plane that is substantially parallel to the first direction, and
the engagement element pivot axis is substantially perpendicular to a first plane in which the first direction extends.

7. A connector as recited in claim 1, wherein:
the engagement element comprises a tactile region and a region adjacent to the tactile region,
an extremity of the tactile region is in a first plane,
the first plane is to a first side of a second plane,
all portions of the region adjacent to the tactile region are to a second side of the second plane, and
the first plane and the second plane are substantially perpendicular to the first direction.

8. A connector as recited in claim 1, wherein:
the adjustment element comprises an adjustment element threaded region,
the post comprises a carriage threaded region, and
the adjustment element threaded region and the carriage threaded region are threaded with each other, such that rotation of the adjustment element about an adjustment element axis causes the adjustment element threaded region to thread relative to the carriage threaded region, whereby the carriage slides linearly in a first direction, the first direction substantially parallel to the adjustment element axis.

9. A connector as recited in claim 1, wherein:
the carriage is linearly slidable, in a first direction, from a carriage first position to a carriage second position,
the carriage is linearly slidable, in a second direction, from the carriage second position to the carriage first position,
the second direction is a substantially opposite direction to the first direction, and
the base is configured to be attached to a surface of a drawer front, the surface of the drawer front defining a drawer front plane that is substantially parallel to the first direction,
whereby linearly sliding the carriage in the first direction or in the second direction causes the engagement element to move relative to the base.

10. A connector as recited in claim 9, wherein:
the connector further comprises a wedge element,
the wedge element is slidably attached to the carriage,
the wedge element is linearly slidable relative to the carriage in a third direction from a wedge element first position to a wedge element second position,
the third direction is substantially perpendicular to the drawer front plane,
the wedge element is linearly slidable relative to the carriage in a fourth direction from the wedge element second position to the wedge element first position,
the fourth direction is a substantially opposite direction to the third direction, and
the wedge element is configured to cause a change in a spacing between a first portion of a drawer movement guide assembly and a portion of a drawer that is on the first portion of the drawer movement guide assembly by the wedge element being moved from the wedge element first position to the wedge element second position.

11. A connector as recited in claim 1, wherein:
the connector further comprises a wedge element,
the wedge element is slidably attached to the carriage and is linearly slidable relative to the carriage between a wedge element first position and a wedge element second position, and
the wedge element is configured to cause a change in a spacing between a first portion of a drawer movement guide assembly and a portion of a drawer that is on the first portion of the drawer movement guide assembly by the wedge element being moved from the wedge element first position to the wedge element second position.

12. A connector as recited in claim 11, wherein the wedge element comprises at least one incremental movement structural feature that is configured to facilitate incremental sliding movement of the wedge element between the wedge element first position and the wedge element second position, and thereby provide incremental changes in the spacing between said portion of a drawer movement guide assembly and said portion of a drawer that is on the portion of the drawer movement guide assembly.

13. A connector as recited in claim 1, wherein:
the connector further comprises a wedge element,
the wedge element is pivotally attached to the carriage and is pivotable relative to the carriage between a wedge element first pivot position and a wedge element second pivot position, and
the wedge element is configured, upon being moved from the wedge element first position to the wedge element second position, to cause a change in a spacing between a portion of a drawer movement guide assembly and a portion of a drawer that is on the portion of the drawer movement guide assembly.

14. A connector as recited in claim 13, wherein the wedge element comprises at least one incremental movement structural feature that is configured to facilitate incremental pivoting movement of the wedge element between the wedge element first pivot position and the wedge element second pivot position, and thereby provide incremental changes in the spacing between said portion of a drawer movement guide assembly and said portion of a drawer that is on the portion of the drawer movement guide assembly.

15. A connector as recited in claim 14, wherein:

the wedge element comprises a pressing plate that is configured to cause the incremental movement structural feature to disengage with a restricting structure attached to the carriage upon the pressing plate being pressed in a direction toward the incremental movement structural feature.

16. A connector as recited in claim 1, wherein:

the engagement element and the carriage are both part of a one-piece structure, the engagement element comprises at least one resilient region, and the engagement element is configured to be biased toward an engagement position upon the engagement element being bent to a disengagement position.

17. A connector, comprising:

a base;

a carriage;

an adjustment element; and a wedge element, the base is configured to be rigidly attached to a drawer, the carriage comprises a post, the adjustment element is mounted on the post, the base comprises locking fingers that engage the post on opposite sides of the adjustment element, the carriage is slidably attached to the base, movement of the adjustment element causes the carriage to slide relative to the base, the wedge element is slidably attached to the carriage and linearly slidable relative to the carriage between a wedge element first position and a wedge element second position, and the wedge element is configured to cause a change in a spacing between a first portion of a drawer movement guide assembly and a portion of a drawer that is on the first portion of the drawer movement guide assembly by the wedge element being moved from the wedge element first position to the wedge element second position.

18. A connector, comprising:

a connector assembly; and an engagement element, the connector assembly comprises a base, a carriage and an adjustment element, a first portion of the connector assembly is configured to be rigidly attached to a drawer, the carriage comprises a post, the adjustment element is mounted on the post, the base comprises locking fingers that engage the post on opposite sides of the adjustment element, the engagement element is configured to releasably engage a drawer movement guide assembly, the engagement element is a separate structure from the connector assembly, the engagement element is pivotally attached to the connector assembly, and the engagement element is pivotable relative to the connector assembly about an engagement element pivot axis.

19. A connector as recited in claim 18, wherein:

the first portion of the connector assembly is in the base, the carriage is slidably attached to the base, and movement of the adjustment element causes the carriage to slide relative to the base.

20. A connector as recited in claim 19, wherein:

the engagement element is pivotally attached to the carriage, and the engagement element is pivotable relative to the carriage about an engagement element pivot axis.

* * * * *